US010095134B2

(12) United States Patent
Hashimoto et al.

(10) Patent No.: US 10,095,134 B2
(45) Date of Patent: Oct. 9, 2018

(54) IMAGE FORMING APPARATUS AND IMAGE FORMING METHOD

(71) Applicant: FUJI XEROX CO., LTD., Tokyo (JP)

(72) Inventors: Kohei Hashimoto, Kanagawa (JP); Hirofumi Nakamura, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/354,342

(22) Filed: Nov. 17, 2016

(65) Prior Publication Data

US 2017/0329243 A1 Nov. 16, 2017

(30) Foreign Application Priority Data

May 10, 2016 (JP) ..... 2016-094645

(51) Int. Cl.
*G03G 5/14* (2006.01)
*G03G 5/043* (2006.01)
*G03G 15/00* (2006.01)

(52) U.S. Cl.
CPC ..... *G03G 5/043* (2013.01); *G03G 15/75* (2013.01)

(58) Field of Classification Search
CPC ..... G03G 5/144; G03G 13/14; G03G 13/16
See application file for complete search history.

(56) References Cited

U.S. PATENT DOCUMENTS 8,802,337 B2 * 8/2014 Kawasaki ..... G03G 5/144 399/111
2009/0226208 A1 * 9/2009 Nukada ..... G03G 5/0539 399/111
2012/0051765 A1 * 3/2012 Kuroda ..... G03G 15/1675 399/44
2014/0051021 A1 * 2/2014 Sakamoto ..... G03G 9/093 430/109.4

FOREIGN PATENT DOCUMENTS

JP 2005-208621 A 8/2005

* cited by examiner

*Primary Examiner* — Peter L Vajda
(74) *Attorney, Agent, or Firm* — Sughrue Mion, PLLC

(57) ABSTRACT

An image forming apparatus includes an electrophotographic photoreceptor which includes an electroconductive substrate, an undercoat layer which is provided on the electroconductive substrate, contains a binder resin and a metal oxide particle, and has an electrostatic capacitance per unit area of from 10 pF/cm$^2$ to 100 pF/cm$^2$, and a photosensitive layer provided on the undercoat layer; an electrostatic latent image forming unit that forms an electrostatic latent image on a charged surface of the electrophotographic photoreceptor; and a developing unit that stores a developer containing a toner which contains toner particles of which a volume average particle diameter is from 3.0 μm to 5.5 μm, and develops the electrostatic latent image formed on the surface of the electrophotographic photoreceptor by using the developer, so as to form a toner image.

12 Claims, 4 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2016-094645 filed May 10, 2016.

BACKGROUND

1. Technical Field

The present invention relates to an image forming apparatus and an image forming method.

2. Related Art

In the related art, an apparatus for sequentially performing charging, forming an electrostatic latent image, developing, transferring, and the like by using an electrophotographic photoreceptor is widely known as an electrophotographic image forming apparatus.

SUMMARY

According to an aspect of the invention, there is provided an image forming apparatus including:

an electrophotographic photoreceptor which includes an electroconductive substrate, an undercoat layer which is provided on the electroconductive substrate, contains a binder resin and a metal oxide particle, and has an electrostatic capacitance per unit area of from 10 pF/cm$^2$ to 100 pF/cm$^2$, and a photosensitive layer provided on the undercoat layer;

a charging unit that charges a surface of the electrophotographic photoreceptor;

an electrostatic latent image forming unit that forms an electrostatic latent image on a charged surface of the electrophotographic photoreceptor;

a developing unit that stores a developer containing a toner which contains toner particles of which a volume average particle diameter is from 3.0 μm to 5.5 μm, and develops the electrostatic latent image formed on the surface of the electrophotographic photoreceptor by using the developer, so as to form a toner image; and a transfer unit that transfers the toner image formed on the surface of the electrophotographic photoreceptor, onto a surface of a recording medium.

BRIEF DESCRIPTION OF THE DRAWINGS

Exemplary embodiments of the present invention will be described in detail based on the following figures, wherein.

DETAILED DESCRIPTION

Figure 1:
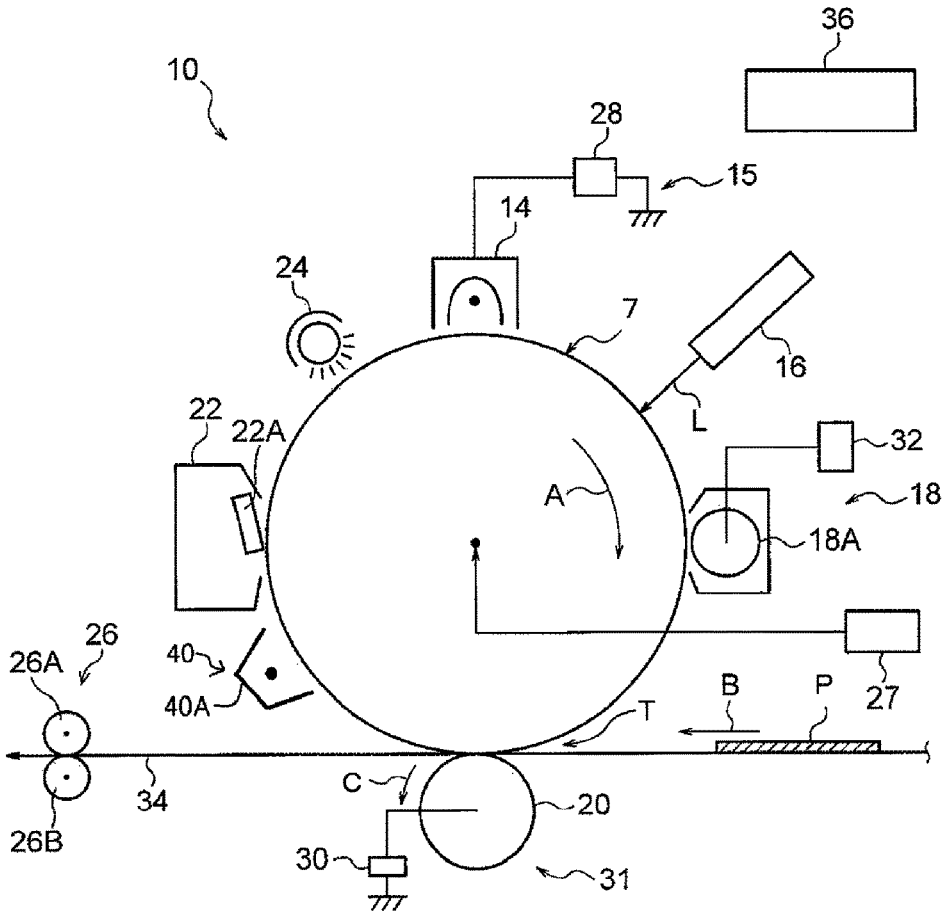
FIG. 1 is a schematic configuration diagram illustrating an example of an image forming apparatus according to an exemplary embodiment, which includes a direct transfer type transfer unit.

Hereinafter, an exemplary embodiment as an example of the present invention will be described in detail.

Image Forming Apparatus

The image forming apparatus according to the present exemplary embodiment includes an electrophotographic photoreceptor, a charging unit that charges a surface of the electrophotographic photoreceptor, an electrostatic latent image forming unit that forms an electrostatic latent image on a charged surface of the electrophotographic photoreceptor, a developing unit that develops the electrostatic latent image formed on the surface of the electrophotographic photoreceptor by using a developer containing a toner, so as to form a toner image, and a transfer unit that transfers the toner image onto a surface of a recording medium.

The electrophotographic photoreceptor (simply referred to "a photoreceptor" below) includes an electroconductive substrate, an undercoat layer provided on the electroconductive substrate, and a photosensitive layer provided on the undercoat layer. The volume average particle diameter of toner particles contained in the toner is from 3.0 μm to 5.5 μm. The undercoat layer contains a binder resin and metal oxide particles. Electrostatic capacitance per unit area of the undercoat layer is from 10 pF/cm$^2$ to 100 pF/cm$^2$.

In the image forming apparatus according to the exemplary embodiment, if the electrostatic capacitance per unit area of the undercoat layer is in the above range, occurrence of a residual image phenomenon (also referred to as "ghost" below) by remaining of a history of the previous image is prevented. The reason is unclear, but is supposed as follows.

If an image is formed by using a toner which includes toner particles of a small diameter (for example, volume average particle diameter is from 3.0 μm to 5.5 μm), for example, in order to form an image having high quality, an amount of the charged toner per unit volume is large. Thus, a large transfer current is required in a transfer process.

Thus, if the transfer current value for transferring a toner image formed on a surface of the electrophotographic photoreceptor is set to be a large value (for example, from 20 μA to 100 μA), and then an image is formed, the residual image phenomenon (ghost) in which the history of the previous image remains when the next image is formed occurs easily.

Here, "the transfer current value" indicates a current value of the transfer current which flows into the photoreceptor from the transfer unit when a toner image is transferred to a transfer medium from the photoreceptor.

The "transfer medium" means a subject to which a toner image on the photoreceptor is directly transferred, regardless of whether the transfer unit is a direct transfer type or an intermediate transfer type. Specifically, for example, in a case where the transfer unit is a direct transfer type, a toner image on the photoreceptor is directly transferred onto a surface of a recording medium. Thus, the recording medium corresponds to the "transfer medium". For example, in a case where the transfer unit is an intermediate transfer type, a toner image on the photoreceptor has been directly primarily transferred to an intermediate transfer member by a primary transfer unit. Then, the toner image on the intermediate transfer member is secondarily transferred to a recording medium by a secondary transfer unit. Thus, the intermediate transfer member corresponds to the "transfer medium".

That is, "the transfer current value" is a value of a transfer current flowing when a toner image is transferred to a recording medium from the photoreceptor in a case where the transfer unit is a direct transfer type. "The transfer current value" is a value of a primary transfer current flowing when a toner image is transferred to the intermediate transfer member from the photoreceptor in a case where the transfer unit is an intermediate transfer type.

It is supposed that the ghost occurs by the following causes. Firstly, regarding electric resistance between the photoreceptor and the transfer unit, the electric resistance in a non-image portion in which a toner image does not exist is smaller than that in an image portion in which a toner image is provided. Thus, if the transfer current value is set to be high, and then a toner image is transferred, a transfer voltage applied to the transfer unit may cause the transfer current to intensively flow into the non-image portion of the photoreceptor, and thus many charges may be accumulated only in a region corresponding to the non-image portion of the photoreceptor.

As described above, if the next image formation is performed in a state where a difference in an accumulated amount of charges occurs largely between the image portion and the non-image portion, many charges having an opposite polarity of a charged potential are accumulated in the non-image portion of the previous image when a charging process is performed. Accordingly, surface charges are cancelled, and thus poor charging is easily caused. As a result, it is supposed that the non-image portion in the previous image is expressed as a history image of the previous image in the next image, and thus the ghost occurs.

On the contrary, in the exemplary embodiment, the electrostatic capacitance per unit area of the undercoat layer is set to be in the above range, and thus the occurrence of the ghost is prevented even though an image is formed by using a toner containing toner particles of which the volume average particle diameter is in the above range (also referred to as "a specific toner" below).

Specifically, the electrostatic capacitance per unit area of the undercoat layer is set to be in the above range which is smaller than that in the related art. Thus, it is difficult to cause the undercoat layer to store charges. Even when the transfer current flows into the photoreceptor from the transfer unit in a transfer process, inflow charges easily flow toward the electroconductive substrate side. Because the inflow charges and charges having an opposite polarity easily move in the undercoat layer, the inflow charges and the charges of the opposite polarity cancel each other, and thus are easily removed. As a result, it is considered that an amount of charges accumulated on the photoreceptor is reduced at a time point when the next image formation is started. Accordingly, in the next image formation, it is difficult to cause poor charging occurring by many charges accumulated only in a specific region. Thus, it is supposed that the occurrence of ghost is difficult.

With the above reason, it is supposed that the electrostatic capacitance per unit area of the undercoat layer is set to be from 10 $pF/cm^2$ to 100 $pF/cm^2$ in the image forming apparatus in which the specific toner is used and the undercoat layer of the photoreceptor contains the binder resin and the metal oxide particles, and thus the image forming apparatus according to the exemplary embodiment prevents the occurrence of the ghost.

Here, as the image forming apparatus according to the present exemplary embodiment, a known image forming apparatus as follows is applied: an apparatus which includes a fixing unit that fixes a toner image transferred onto the surface of a recording medium; a direct transfer type apparatus that directly transfers a toner image formed on the surface of the electrophotographic photoreceptor, to a recording medium; an intermediate transfer type apparatus that primarily transfers a toner image formed on the surface of the electrophotographic photoreceptor onto the surface of an intermediate transfer member, and secondarily transfers the toner image transferred on the surface of the intermediate transfer member onto the surface of a recording medium; an apparatus which includes a cleaning unit that performs cleaning of the surface of the electrophotographic photoreceptor after transferring the toner image and before charging the surface of the electrophotographic photoreceptor; an apparatus which includes an erasing unit that erases the charge by irradiating the surface of the electrophotographic photoreceptor with erasing light after transferring the toner image and before charging the surface of the electrophotographic photoreceptor; and an apparatus which includes an electrophotographic photoreceptor heating member that raises the temperature of an electrophotographic photoreceptor and lowers the relative temperature.

The image forming apparatus according to the exemplary embodiment may be either an image forming apparatus of dry developing type or an image forming apparatus of a wet developing type (a developing type using a developer liquid).

In the image forming apparatus according to the exemplary embodiment, for example, a portion including the electrophotographic photoreceptor may be a cartridge structure (process cartridge) which is detachable from the image forming apparatus. The process cartridge may include at least one selected from, for example, a group which is formed from a charging unit, an electrostatic latent image forming unit, a developing unit, and a transfer unit, in addition to the electrophotographic photoreceptor.

Hereinafter, the image forming apparatus according to the exemplary embodiment will be described in detail with reference to the drawings.

FIG. 1 is a schematic configuration diagram illustrating an example of a configuration of the image forming apparatus according to the exemplary embodiment.

As illustrated in FIG. 1, an electrophotographic photoreceptor 7 is provided in an image forming apparatus 10 according to the exemplary embodiment. The electrophotographic photoreceptor 7 has a columnar shape. The electrophotographic photoreceptor 7 is linked to a driving motor 27 (an example of a driving unit) through a driving-force transmission member (not illustrated) such as a gear. The driving motor 27 causes the electrophotographic photoreceptor 7 to be rotationally driven (in a direction indicated by an arrow A in FIG. 1).

For example, the following units are sequentially arranged around the electrophotographic photoreceptor 7 (an example of an image holding member) in a rotation direction of the electrophotographic photoreceptor 7: a charging device (an example of a charging unit) 15; an electrostatic latent image forming device (an example of an electrostatic latent image forming unit) 16; a developing device (an example of a developing unit) 18; a direct transfer type transfer device 31 (an example of a transfer unit; simply also referred to as "a transfer device ("a transfer unit") below); recharging device 40 of a non-contact charging type (an example of a recharging unit of a non-contact charging type; simply also referred to as "a recharging device" ("recharging unit") below); a cleaning device (cleaning device) (an example of a cleaning unit) 22; and an erasing device (an example of an erasing unit) 24. A fixing device 26 is also disposed in the image forming apparatus 10 according to the exemplary embodiment. A control device 36 which is connected to the devices and the members in the image forming apparatus 10, and is configured to control operations of the devices and the members is also provided.

A configuration of the image forming apparatus according to the exemplary embodiment will be described below.

Electrophotographic Photoreceptor

As the electrophotographic photoreceptor 7, a photoreceptor having a configuration of including an electroconductive substrate, an undercoat layer provided on the electroconductive substrate, and a photosensitive layer provided on the undercoat layer is applied.

The photosensitive layer may be a photosensitive layer of a function separation type which includes a charge generation layer and a charge transport layer (also referred to as "a function-separated type photosensitive layer" below), or be a photosensitive layer of a single layer type (also referred to as "a single-layer type photosensitive layer" below). In a case where the photosensitive layer is a function-separated type photosensitive layer, the charge generation layer contains a charge generating material, and the charge transport layer contains a charge transporting material.

The electrophotographic photoreceptor according to the exemplary embodiment will be described below in detail with reference to the drawings.

Figure 2:
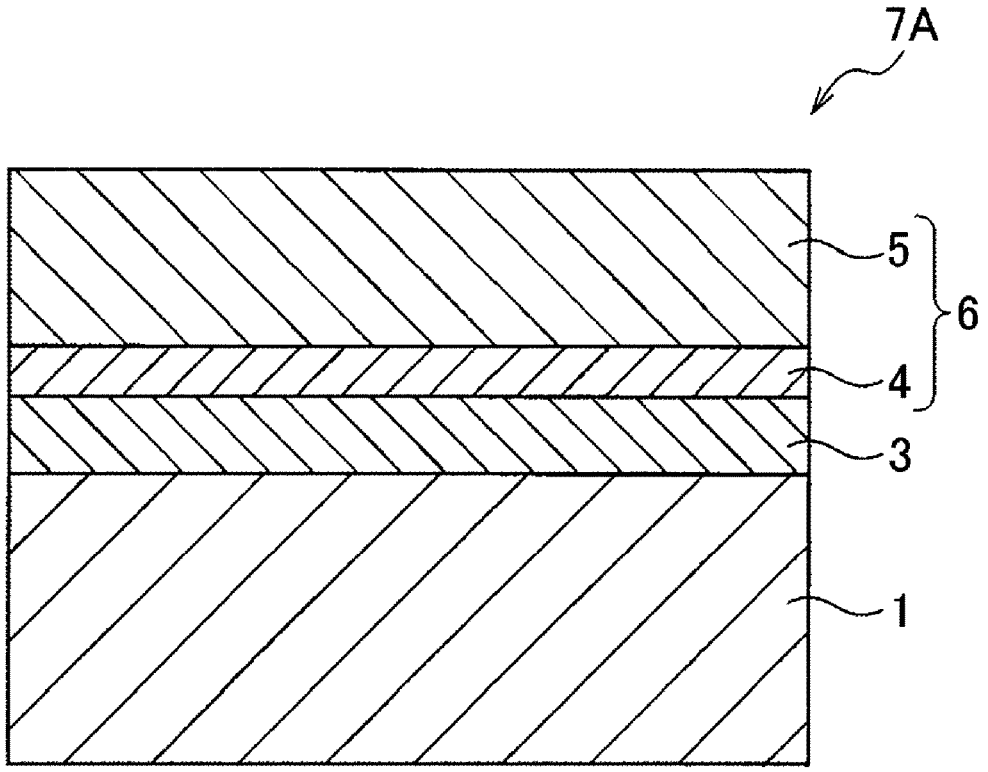
FIG. 2 is a schematic partially-sectional view illustrating an example of a layer configuration of an electrophotographic photoreceptor according to the exemplary embodiment.

FIG. 2 is a schematic sectional view illustrating an electrophotographic photoreceptor 7A as an example of a layer configuration of the electrophotographic photoreceptor 7. The electrophotographic photoreceptor 7A illustrated in FIG. 2 has a structure in which an undercoat layer 3, a charge generation layer 4, and a charge transport layer 5 are stacked on an electroconductive substrate 1 in this order. The charge generation layer 4 and the charge transport layer 5 constitute a function-separated type photosensitive layer 6.

The electrophotographic photoreceptor 7A may include other layers if necessary. As the layer provided if necessary, for example, a protective layer which is further provided on the charge transport layer 5 is exemplified.

Figure 3:
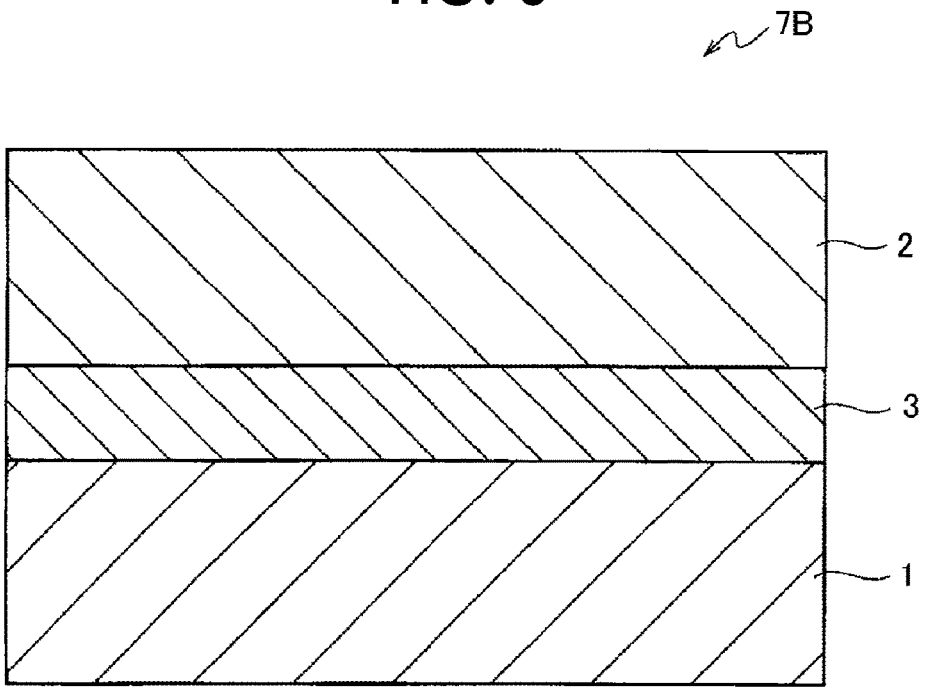
FIG. 3 is a schematic partially-sectional view illustrating another example of the layer configuration of the electrophotographic photoreceptor according to the exemplary embodiment.

FIG. 3 is a schematic sectional view illustrating an electrophotographic photoreceptor 7B as another example of the layer configuration of the electrophotographic photoreceptor 7. The electrophotographic photoreceptor 7B illustrated in FIG. 3 has a structure in which an undercoat layer 3 and a single-layer type photosensitive layer 2 are stacked on an electroconductive substrate 1 in this order.

The electrophotographic photoreceptor 7B may include other layers if necessary. As the layer provided if necessary, for example, a protective layer which is further provided on the single-layer type photosensitive layer 2 is exemplified.

Each of the layers of the electrophotographic photoreceptor 7 will be described below in detail. Descriptions will be made with the reference signs omitted.

Electroconductive Substrate

Examples of the electroconductive substrate include metal plates, metal drums, and metal belts containing metals (aluminum, copper, zinc, chromium, nickel, molybdenum, vanadium, indium, gold, platinum, and the like) or alloys (stainless steel and the like). Other examples of the electroconductive substrate include paper, resin films, and belts, each formed by applying, depositing, or laminating conductive compounds (for example, a conductive polymer and indium oxide), metals (for example, aluminum, palladium, and gold), or alloys. The term "being conductive" herein refers to having a volume resistivity of less than $10^{13}$ Ω·cm.

In the case where the electrophotographic photoreceptor is used in a laser printer, the surface of the electroconductive substrate is preferably roughened at a center-line average roughness, Ra, which is from 0.04 μm to 0.5 μm in order to prevent an interference fringe generated upon radiation with laser light. In the case where an incoherent light source is used, there is no particular need for the surface of the electroconductive substrate to be roughened so as to prevent an interference fringe, and such an incoherent light source may prevent occurrence of defects due to uneven surface of the electroconductive substrate, and is therefore more suitable for prolonging the lifetime.

Examples of a surface roughening method include wet honing in which an abrasive suspended in water is sprayed to a support, centerless grinding in which continuous grinding is carried out by pressing the electroconductive substrate against a rotating grindstone, and an anodization treatment.

Other examples of the surface roughening method include a method in which while not roughening the surface of the electroconductive substrate, conductive or semiconductive powder is dispersed in a resin, the resin is applied onto the surface of the electroconductive substrate to form a layer, and roughening is carried out by the particles dispersed in the layer.

In the surface roughening treatment by anodization, an electroconductive substrate formed of a metal (for example, aluminum) serves as the anode in an electrolyte solution and is anodized to form an oxide film on the surface of the electroconductive substrate. Examples of the electrolyte solution include a sulfuric acid solution and an oxalic acid solution. A porous anodized film formed by anodizing is, however, chemically active in its natural state, and thus, such an anodized film is easily contaminated, and its resistance greatly varies depending on environment. Accordingly, a treatment for closing the pores of the porous anodized film is preferably carried out; in such a process, the pores of the oxidized film are closed by volume expansion due to a hydration reaction in steam under pressure or in boiled water (a metal salt such as nickel may be added), and the porous anodized film is converted into more stable hydrous oxide.

The film thickness of the anodized film is preferably, for example, from 0.3 μm to 15 μm. If the film thickness is within this range, a barrier property for implantation tends to be exerted and an increase in residual potential due to repeated uses tends to be prevented.

The electroconductive substrate may be subjected to a treatment with an acidic treatment solution or a boehmite treatment.

The treatment with an acidic treatment solution is carried out, for example, as follows. An acidic treatment solution containing phosphoric acid, chromic acid, and hydrofluoric acid is prepared. For the blend ratio of the phosphoric acid, the chromic acid, and the hydrofluoric acid in the acidic treatment solution, for example, the amount of the phosphoric acid is in the range from 10% by weight to 11% by weight, the amount of the chromic acid is in the range from 3% by weight to 5% by weight, and the amount of the hydrofluoric acid is in the range from 0.5% by weight to 2% by weight, and the total concentration of these acids is preferably in the range from 13.5% by weight to 18% by weight. The temperature for the treatment is preferably, for example, from 42° C. to 48° C. The film thickness of the coating film is preferably from 0.3 μm to 15 μm.

In the boehmite treatment, for example, the electroconductive substrate is immersed into pure water at a temperature from 90° C. to 100° C. from 5 minutes to 60 minutes or brought into contact with heated water vapor at a temperature from 90° C. to 120° C. from 5 minutes to 60 minutes. The film thickness of the coating film is preferably from 0.1 μm to 5 μm. The obtained product may be subjected to an anodization treatment with an electrolyte solution which less dissolves the coating film, such as adipic acid, boric acid, borate, phosphate, phthalate, maleate, benzoate, tartrate, and citrate.

Undercoat Layer

The undercoat layer is provided between the electroconductive substrate and the photosensitive layer, and contains a binder resin and a metal oxide particle, and has an electrostatic capacitance per unit area of from 10 pF/cm$^2$ to 100 pF/cm$^2$.

As described above, the electrostatic capacitance per unit area of the undercoat layer is within the above range, and thereby, the occurrence of ghost is prevented in comparison to a case of being more than the above range. The electrostatic capacitance per unit area of the undercoat layer is within the above range, and thus good electrical characteristics of the photoreceptor are obtained easier than in a case of being less than the above range.

The electrostatic capacitance per unit area of the undercoat layer is preferably from 20 pF/cm$^2$ to 80 pF/cm$^2$, and more preferably from 30 pF/cm$^2$ to 60 pF/cm$^2$, from a viewpoint of preventing the occurrence of ghost.

Here, a method of obtaining the electrostatic capacitance per unit area of the undercoat layer will be described.

For example, as an equivalent circuit of a conductive organic film constituting each of the layers in the electrophotographic photoreceptor, generally, a parallel circuit of a resistor (resistance value: R) and a capacitor (electrostatic capacitance: C) is applied. As a method of analyzing and calculating a resistance value R and an electrostatic capacitance C in a parallel circuit in which the resistance value R and the electrostatic capacitance C are unknown, Cole-Cole Plot analysis is exemplified.

The Cole-Cole Plot analysis refers to a method in which electrodes are attached to both ends of a parallel circuit (for example, conductive organic film) in which a resistance value R and an electrostatic capacitance C are unknown, an AC voltage is applied to the both of the electrodes while changing a frequency, and a positional relationship between the applied voltage and the obtained current is analyzed. The resistance value R and the electrostatic capacitance C in the parallel circuit are obtained by using this method, and the electrostatic capacitance per unit area is obtained based on the obtained value of the electrostatic capacitance C and a value of an area of the attached electrode.

Specifically, for example, firstly, gold electrodes of φ6 mm as facing electrodes are formed on the outer circumferential surface of the undercoat layer by a vapor deposition method, and then measuring is performed at a normal temperature and normal humidity (22° C./50% RH) by the 126096 W impedance analyzer (manufactured by Solartron Corp.).

As measuring conditions, for example, a DC vias (applied DC voltage) of 0 V, an AC (applied AC voltage) of ±1 V, and a frequency in a range of from 1 Hz to 100 Hz are exemplified.

The electrostatic capacitance C is obtained based on the obtained measurement result, by the Cole-Cole Plot analysis, and is divided by an electrode area S (cm$^2$) of the facing electrode. Thus, the electrostatic capacitance per unit area of the undercoat layer is calculated.

As a method of measuring the electrostatic capacitance per unit area from a photoreceptor functioning as a measurement target, for example, the following method is exemplified.

Firstly, a photoreceptor functioning as a measurement target is prepared. Next, for example, a photosensitive layer such as a charge generation layer and a charge transport layer, which covers an undercoat layer is removed by using a solvent such as acetone, tetrahydrofuran, methanol, ethanol, and thus the undercoat layer is exposed. A gold electrode is formed on the exposed undercoat layer by a unit using a vapor deposition method, a sputtering method, or the like, thereby a measurement sample is obtained. Measurement is performed on this measurement sample, and thus the electrostatic capacitance per unit area is obtained.

A method of controlling the electrostatic capacitance per unit area of the undercoat layer is not particularly limited. In a case where the undercoat layer is a layer containing a binder resin, a metal oxide particle, and an electron accepting compound, for example, the following methods are exemplified: a method of adjusting dispersity of metal oxide particles in the undercoat layer; a method of adjusting a particle diameter of the metal oxide particle; a method of adjusting a surface-treating amount of metal oxide particles (that is, an amount of a surface treating agent used in surface treatment of metal oxide particles); a method of adjusting the content of metal oxide particles (content when the surface treating agent is also contained in a case where the surface treating agent adheres to the surfaces of the metal oxide particles); a method of changing a combination of the type of the surface treating agent for the metal oxide particle and the type of the binder resin; a method of adjusting the content of the electron accepting compound; and a method obtained by combining the above-described methods.

Specifically, an appropriate adjusting method varies depending on a condition such as types of various materials, a combination, and the content. For example, if the dispersity of the metal oxide particles is decreased, the electrostatic capacitance of the undercoat layer tends to be decreased. If the dispersity of the metal oxide particles is increased, the electrostatic capacitance of the undercoat layer tends to be increased.

In a case where a coating film of a coating liquid for forming an undercoat layer, in which the metal oxide particles are dispersed, is formed so as to form the undercoat layer, secondary particles obtained by aggregating primary particles may exist along with the primary particles of the metal oxide particles in the film of the formed undercoat layer. The metal oxide particles of the secondary particles have a particle diameter more than that of the primary particles, and existence of these secondary particles cause a path on which charges move to be easily formed. Thus, for example, the dispersity of the metal oxide particles is adjusted to control the metal oxide particles of the secondary particles, so that the electrostatic capacitance per unit area of the undercoat layer is controlled.

Specifically, in a case where the dispersity of the metal oxide particles is low (that is, in a case where a dispersion particle diameter of the metal oxide particles is large), mobility of charges in the undercoat layer is increased, and the electrostatic capacitance per unit area is easily decreased. In a case where the dispersity of the metal oxide particles is high (that is, in a case where the dispersion particle diameter of the metal oxide particles is small), the mobility of charges in the undercoat layer is decreased, and the electrostatic capacitance per unit area tends to be easily increased.

As the method of adjusting the dispersity, for example, a method of performing adjustment in accordance with a dispersing time and the like of the metal oxide particles when the coating liquid for forming an undercoat layer is formed is exemplified.

For example, if the particle diameter of the metal oxide particles is set to be large, the electrostatic capacitance of the undercoat layer is decreased. If the particle diameter of the metal oxide particles is set to be small, the electrostatic capacitance of the undercoat layer tends to be increased.

Further, in a case where a zinc oxide particle which has an amino group and is subjected to surface treatment by the silane coupling agent is used as the metal oxide particle, and an acetal resin is used as the binder resin, for example, if the surface-treating amount of metal oxide particles is large, the dispersity of the metal oxide particles is decreased, and thus the electrostatic capacitance of the undercoat layer is decreased. If the surface-treating amount of the metal oxide particles is small, the dispersity of the metal oxide particles is increased, and thus the electrostatic capacitance of the undercoat layer tends to be increased.

For example, if the content of the metal oxide particles is large, an amount of the binder resin is decreased, and thus the electrostatic capacitance of the undercoat layer is decreased. If the content of the metal oxide particles is small, the amount of the binder resin is increased, and thus the electrostatic capacitance of the undercoat layer tends to be increased.

For example, if the content of the electron accepting compound is large, the electrostatic capacitance of the undercoat layer is decreased. If the content of the electron accepting compound is small, the electrostatic capacitance of the undercoat layer tends to be increased.

Regarding a layer which contains the binder resin, the metal oxide particles, and the electron accepting compound, as an example of the undercoat layer, a material, a preparing method, characteristics, and the like will be described below.

Metal Oxide Particle

Examples of the metal oxide particle include a tin oxide particle, a titanium oxide particle, a zinc oxide particle, and a zirconium oxide particle. Among these particles, at least one type selected from the tin oxide particle, the titanium oxide particle, and the zinc oxide particle is preferable, and the zinc oxide particle is more preferable.

As the volume average primary particle diameter of metal oxide particles, for example, a range of from 10 nm to 200 nm is exemplified.

The volume average primary particle diameter of the metal oxide particles is in the above range, and thus uneven distribution in a dispersion, which may be caused by an excessively-large surface area of the metal oxide particles, is prevented in comparison to a case of being less than the above range. The volume average primary particle diameter of the metal oxide particles is in the above range, and thus uneven distribution in the undercoat layer, which may be caused by an excessively-large particle diameter of secondary particles or particles having a high order more than the secondary particles, is prevented in a case of being more than the above range. If the uneven distribution occurs in the undercoat layer, a sea-island structure including a portion at which the metal oxide particles exist and a portion at which the metal oxide particles do not exist is formed in the undercoat layer, and thus an image defect such as unevenness of half-tone density may be caused.

The volume average primary particle diameter of the metal oxide particles is preferably from 20 nm to 200 nm, and more preferably from 30 nm to 100 nm, from a viewpoint of adjusting the electrostatic capacitance per unit area of the undercoat layer to be in the above range.

The volume average primary particle diameter of the metal oxide particles is measured by using a laser-diffraction type particle diameter distribution measuring device (LA-700: HORIBA, Ltd.). Regarding a measuring method, a sample in a state of being a dispersion is adjusted by using a solid powder, so as to be 2 g. Ion exchange water is added to the adjusted sample, thereby 40 ml is obtained. The resultant is inserted into a cell so as to have an appropriate concentration, and waits for 2 minutes. Then, measurement is performed. Among particle diameters of obtained channels, accumulation is performed from a small particle diameter with a volume as a standard. A value when the accumulated value reaches 50% is defined as the volume average primary particle diameter.

As volume resistivity of the metal oxide particles, for example, a range of from $10^4$ Ω·cm to $10^{10}$ Ω·cm is exemplified.

It is preferable that the undercoat layer obtains appropriate impedance at a frequency corresponding to an electrophotographic process speed. From this viewpoint, the volume resistivity of the metal oxide particles is preferably in the above range. That is, the volume resistivity of the metal oxide particles is in the above range, and thus an inclination of particle content dependency of the impedance becomes smaller, and control difficulty of the impedance is easily prevented, in comparison to a case of being lower than the above range. The volume resistivity of the metal oxide particles is in the above range, and thus an increase of the residual potential is prevented easier than in a case of being higher than the above range.

From a viewpoint of adjusting the electrostatic capacitance per unit area of the undercoat layer to be in the above range, the volume resistivity of metal oxide particles is preferably from $3\times10^6$ Ω·cm to $3\times10^9$ Ω·cm, and more preferably from $5\times10^6$ Ω·cm to $1\times10^9$ Ω·cm.

The volume resistivity of metal oxide particles is measured in the following manner. A measurement environment is defined as a temperature of 20° C., and humidity of 50% RH.

Firstly, metal oxide particles are separated from the layer. The separated metal oxide particles to be measured are placed on a surface of a circular tool on which an electrode plate of 20 $cm^2$ is disposed, so as to have a thickness of about from 1 mm to 3 mm. Thus, a metal oxide particle layer is formed. The similar electrode plate of 20 $cm^2$ is placed on the formed metal oxide particle layer, and thus the metal oxide particle layer is nipped between the electrode plates. In order to cause void between the metal oxide particles not to be provided, a load of 4 kg is applied onto the electrode plate placed on the metal oxide particle layer, and then the thickness (cm) of the metal oxide particle layer is measured. Both of the electrodes on and under the metal oxide particle layer are connected to an electrometer and a high-voltage power generation device. A high voltage is applied to both of the electrodes, so as to cause an electric field to have a predetermined value. A value (A) of a current flowing at this time is read, and thus the volume resistivity (Ω·cm) of the metal oxide particles is calculated. A calculation expression of the volume resistivity (Ω·cm) of the metal oxide particles is as follows.

In the expression, ρ represents the volume resistivity (Ω·cm) of the metal oxide particles, E represents an applied voltage (V), and I represents a current value (A). $I_0$ represents the current value (A) at the applied voltage of 0 V, and L represents a thickness (cm) of the metal oxide particle layer. In this evaluation, volume resistivity is used when the applied voltage is 1,000 V.

$$\rho = E \times 20/(I - I_0)/L \quad \text{Expression:}$$

As a BET specific surface area of the metal oxide particles, for example, a range of 10 $m^2/g$ or more is exemplified. From a viewpoint of adjusting the electrostatic capacitance per unit area of the undercoat layer to be in the above range, the BET specific surface area is preferably from 10 $m^2/g$ to 30 $m^2/g$, and more preferably from 15 $m^2/g$ to 25 $m^2/g$.

The BET specific surface area has a value measured by a nitrogen substitution method using a BET specific surface area measuring instrument (FLOWSORP II 2300 manufactured by Shimadzu Corporation).

As the content of the metal oxide particles, for example, a range of from 20% by weight to 80% by weight with respect to the total solid content of the undercoat layer is exemplified. From a viewpoint of maintaining electrical characteristics, the content of the metal oxide particles is preferably from 25% by weight to 75% by weight. From a viewpoint of adjusting the electrostatic capacitance per unit area of the undercoat layer to be in the above range, the content of the metal oxide particles is preferably from 20% by weight to 80% by weight, and more preferably from 25% by weight to 75% by weight, with respect to the total solid content of the undercoat layer.

The metal oxide particles may be subjected to surface treatment by using a surface treating agent, and is preferably subjected to surface treatment by using one or more types of coupling agents among surface treating agents. The coupling agent generally has an action of chemically bonding an organic material and an inorganic material. For example, a compound containing a functional group which has affinity or reactivity with the surfaces of the metal oxide particles is exemplified.

As the metal oxide particle, a mixture of two or more types of metal oxide particles which are subjected to different surface treatments may be used, or a mixture of two or more types of metal oxide particles which have different particle diameters may be used.

Examples of the surface treating agent include a silane coupling agent, a titanate coupling agent, an aluminum coupling agent, and a surfactant. Particularly, a silane coupling agent is preferable, and a silane coupling agent having an amino group is more preferable.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more types of silane coupling agents may be used as a mixture. For example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy) silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method by using a surface treating agent may be any known method, and may be either a dry type method or a wet type method.

The metal oxide particles are subjected to surface treatment by, for example, using the coupling agent, and then, if necessary, may be subjected to thermal treatment for the purpose of, for example, improving environment dependency of the volume resistivity of the metal oxide particles. As a temperature in the thermal treatment, for example, a range of from 150° C. to 300° C. is exemplified. As a treating time in the thermal treatment, for example, a range of from 30 minutes to 5 hours is exemplified.

Electron Accepting Compound

The electron accepting compound may be contained in the undercoat layer after having been dispersed together with the metal oxide particles therein, or may be contained in a state of having adhered to the surfaces of the metal oxide particles. In a case where the electron accepting compound is contained in the state of having adhered to the surfaces of the metal oxide particles, the electron accepting compound is preferably a material which conducts a chemical reaction with the surfaces of the metal oxide particles, or a material which adheres to the surfaces of the metal oxide particles. The electron accepting compound may be selectively provided on the surfaces of the metal oxide particles.

An example of the electron accepting compound includes an electron accepting compound which has a quinone skeleton, an anthraquinone skeleton, a coumarin skeleton, a phthalocyanine skeleton, a triphenylmethane skeleton, an anthocyanin skeleton, a flavone skeleton, a fullerene skeleton, a ruthenium complex skeleton, a xanthene skeleton, a benzoxazine skeleton, and a porphyrin skeleton.

The electron accepting compound may be a compound in which substitution with a substituent such as an acidic group (for example, a hydroxyl group, a carboxyl group, and a sulfonyl group), an aryl group, and an amino group is performed in the skeletons.

Particularly, from a viewpoint of adjusting the electrostatic capacitance per unit area of the undercoat layer to be the above range, as the electron accepting compound, an electron accepting compound having an anthraquinone skeleton is preferable. An electron accepting compound having a hydroxy anthraquinone skeleton (anthraquinone skeleton having a hydroxyl group) is more preferable.

A specific example of the electron accepting compound having a hydroxy anthraquinone skeleton includes a compound represented by the following formula (1).

Formula (1)

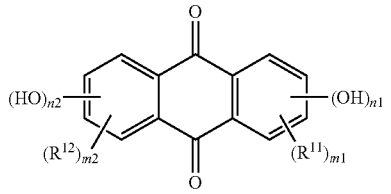

In the formula (1), n1 and n2 each independently represent an integer of from 0 to 3, provided that at least one of n1 and n2 represents an integer of from 1 to 3 (that is, n1 and n2 do not simultaneously represent 0). m1 and m2 each independently represent an integer of 0 or 1. $R^{11}$ and $R^{12}$ each independently represent an alkyl group having from 1 to 10 carbon atoms, or an alkoxy group having from 1 to 10 carbon atoms.

The electron accepting compound may be a compound represented by the following formula (2).

Formula (2)

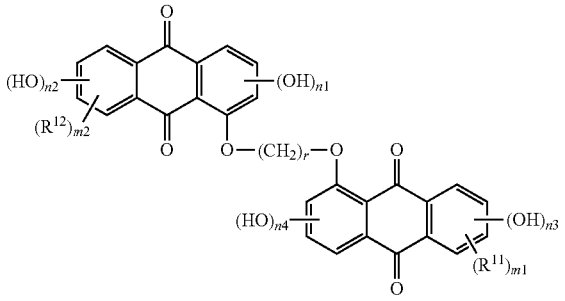

In the formula (2), n1, n2, n3 and n4 each independently represent an integer of from 0 to 3. m1 and m2 each independently represent an integer of 0 or 1. At least one of n1 and n2 each independently represents an integer of from 1 to 3 (that is, n1 and n2 do not simultaneously represent 0). At least one of n3 and n4 each independently represents an integer of from 1 to 3 (that is, n3 and n4 do not simultaneously represent 0). r represents an integer of from 2 to 10. $R^{11}$ and $R^{12}$ each independently represent an alkyl group having from 1 to 10 carbon atoms, or an alkoxy group having from 1 to 10 carbon atoms.

Here, in the formulae (1) and (2), an alkyl group which is represented by $R^{11}$ and $R^{12}$ and has from 1 to 10 carbon atoms may be either of a linear or a branched alkyl group. For example, a methyl group, an ethyl group, a propyl group, and an isopropyl group are exemplified. As the alkyl group having from 1 to 10 carbon atoms, an alkyl group having from 1 to 8 carbon atoms is preferable, and an alkyl group having from 1 to 6 carbon atoms is more preferable.

An alkoxy group (alkoxyl group) which is represented by $R^{11}$ and $R^{12}$ and has from 1 to 10 carbon atoms may be either of a linear or a branched alkoxy group. For example, a methoxy group, an ethoxy group, a propoxy group, and an isopropoxy group are exemplified. As the alkoxy group having from 1 to 10 carbon atoms, an alkoxyl group having from 1 to 8 carbon atoms is preferable, and an alkoxyl group having from 1 to 6 carbon atoms is more preferable.

A specific example of the electron accepting compound will be described below, but is not limited thereto.

1-1

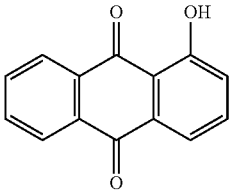

-continued 1-2

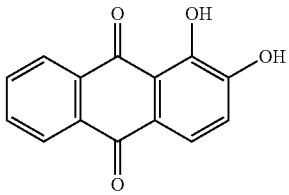

1-3

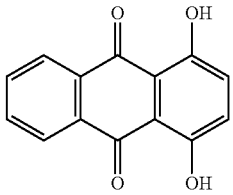

1-4

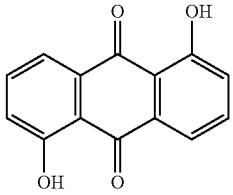

1-5

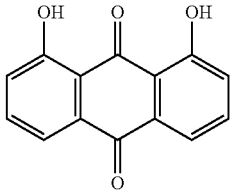

1-6

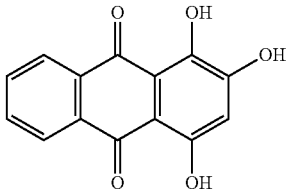

1-7

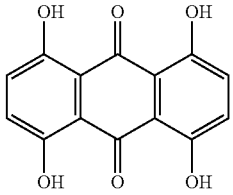

1-8

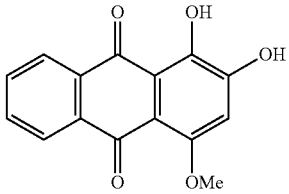

1-9

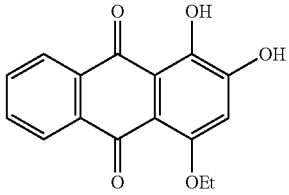

-continued
1-10
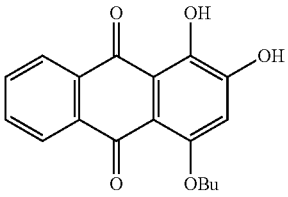
1-11
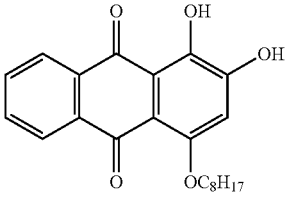
1-12
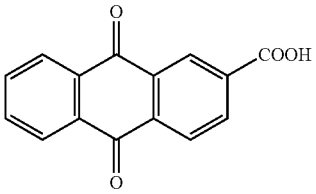
1-13
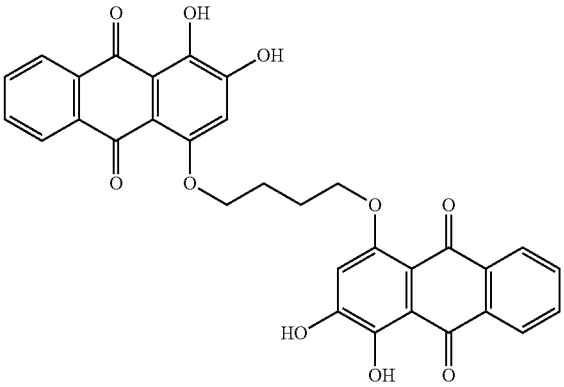
1-14
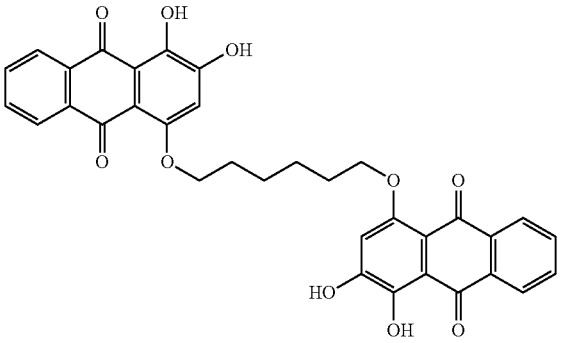
1-15
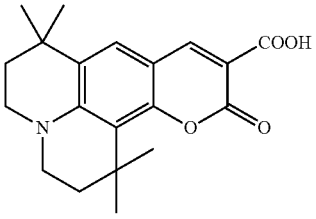
-continued
1-16
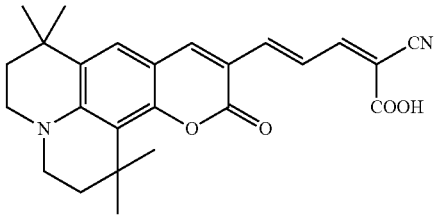
1-17
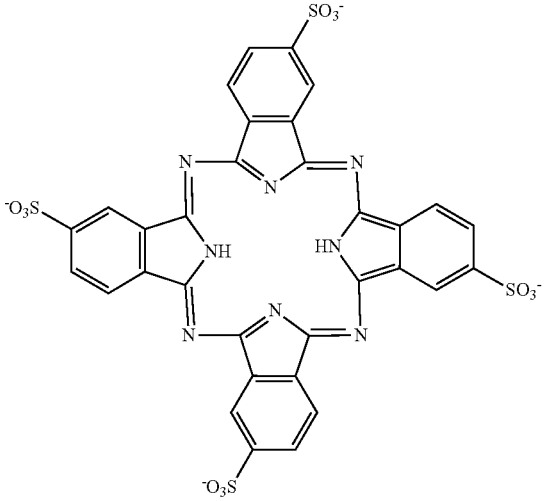
1-18
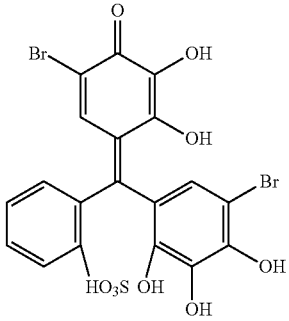
1-19
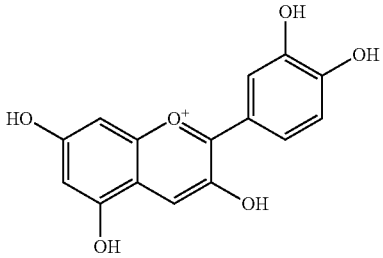
1-20
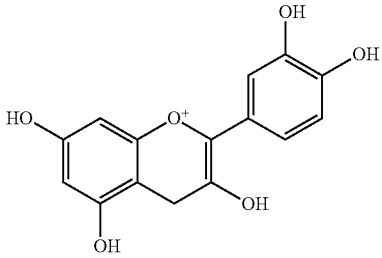

-continued 1-21

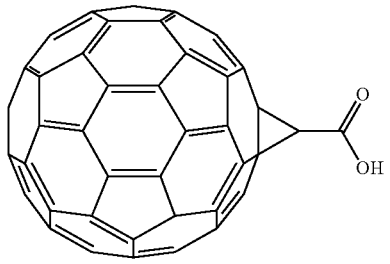

1-22

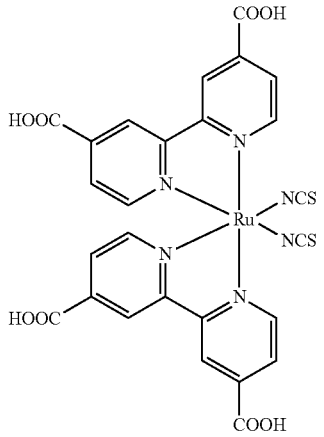

Examples for allowing the electron accepting compound to adhere to the surfaces of the metal oxide particles include a dry type method and a wet type method.

The dry type method is, for example, a method in which an electron accepting compound is allowed to adhere to the surfaces of the metal oxide particles as follows: metal oxide particles are stirred in a mixer with a high shear force, and in this state, the electron accepting compound as it is or as a solution in which the electron accepting compound dissolved in an organic solvent is dropped or sprayed along with dried air or a nitrogen gas. The electron accepting compound may be dropped or sprayed at a temperature that is equal to or lower than the boiling point of the solvent. After dropping or spraying the electron accepting compound, baking may be carried out at equal to or higher than 100° C. Baking may be carried out at any temperature for any length of time provided that electrophotographic properties are obtained.

The wet type method is, for example, a method in which the electron accepting compound is allowed to adhere to the surfaces of the metal oxide particles as follows: the metal oxide particles are dispersed in a solvent by a technique involving stirring, ultrasonic wave, a sand mill, an attritor, or a ball mill, in this state, the electron accepting compound is added thereto and then stirred or dispersed, and the solvent is subsequently removed. The solvent is removed through, for example, being filtered or distilled off by distillation. After the removal of the solvent, baking may be carried out at equal to or higher than 100° C. Baking may be carried out at any temperature for any length of time provided that electrophotographic properties are obtained. In the wet type method, the contained moisture in the metal oxide particles may be removed in advance of the addition of the electron accepting compound, and examples of the wet type method include a method in which the contained moisture is removed by stirring in a solvent under heating or a method in which the contained moisture is removed by azeotropy with a solvent.

The electron accepting compound may be allowed to adhere before or after metal oxide particles are subjected to surface treatment by using the surface treating agent. In addition, the adhesion of the electron accepting compound and the surface treatment with the surface treating agent may be simultaneously carried out.

As the content of the electron accepting compound, for example, a range of from 0.01% by weight to 20% by weight with respect to the total solid content of the undercoat layer is exemplified. The content of the electron accepting compound is preferably from 0.1% by weight to 10% by weight, and more preferably from 0.5% by weight to 5% by weight.

The content of the electron accepting compound is in the above range, and thus an effect of the electron accepting compound as an acceptor is obtained easier than in a case of being less than the above range. The content of the electron accepting compound is in the above range, and thus it is difficult to aggregate metal oxide particles and to cause uneven distribution of the metal oxide particles to excessively occur in the undercoat layer in comparison to a case of being more than the above range. In addition, it is difficult to cause an increase of the residual potential, occurrence of a black spot, and occurrence of unevenness of half-tone density due to excessive uneven distribution of the metal oxide particles.

Binder Resin

Examples of the binder resin to be used in the undercoat layer include known high molecular compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin for use in the undercoat layer include charge transporting resins having charge transporting groups and conductive resins (for example, polyaniline).

Among these materials, a resin that is insoluble in a solvent used in coating for forming the upper layer is suitable as the binder resin to be used in the undercoat layer. In particular, resins obtained by a reaction of a curing agent with at least one resin selected from the group consisting of thermosetting resins such as urea resins, phenolic resins, phenol-formaldehyde resins, melamine resins, urethane resins, unsaturated polyester resins, alkyd resins, and epoxy resins; polyamide resins; polyester resins; polyether resins; methacrylic resins; acrylic resins; polyvinyl alcohol resins; and polyvinyl acetal resins are suitable.

In the case where two or more kinds of these binder resins are used in combination, the mixing ratio thereof is determined, as necessary.

Additive

The undercoat layer may contain various additives in order to improve electrical properties, environmental stability, and image quality.

Examples of the additives include an electron transporting pigment such as a condensed polycyclic pigment and an azo pigment, and known materials such as zirconium chelate compounds, titanium chelate compounds, aluminum chelate compounds, titanium alkoxide compounds, organic titanium compounds, and silane coupling agents. The silane coupling agent is used for the surface treatment of the metal oxide particles as described above, but may be further added to the undercoat layer, as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-normal-butyl titanate, butyl titanate dimers, tetra(2-ethylhexyl)titanate, titanium acetylacetonate, polytitanium acetylacetonate, titanium octylene glycolate, titanium lactate ammonium salts, titanium lactate, titanium lactate ethyl esters, titanium triethanol aminate, and polyhydroxytitanium stearate.

Examples of the aluminum chelate compound include aluminum isopropylate, monobutoxyaluminum diisopropylate, aluminum butylate, diethyl acetoacetate aluminum diisopropylate, and aluminum tris(ethyl acetoacetate).

These additives may be used singly or as a mixture or a polycondensate of plural kinds thereof.

The undercoat layer may have Vickers hardness of 35 or more.

In order to prevent a moire fringe, surface roughness (ten-point average roughness) of the undercoat layer may be adjusted to a range from 1/(4n) (n is the refractive index of the upper layer) to ½ of the wavelength λ of the exposure laser to be used.

In order to adjust the surface roughness, resin particles or the like may be added to the undercoat layer. Examples of the resin particles include silicone resin particles and cross-linked polymethyl methacrylate resin particles. In addition, the surface of the undercoat layer may be polished to adjust the surface roughness. Examples of a polishing method include buffing polishing, sand blasting treatment, wet honing, and grinding treatment.

Forming Method of Undercoat Layer

A technique for forming the undercoat layer is not particularly limited, and any known technique is used. For example, a coating film of a coating liquid for forming an undercoat layer, which is obtained by adding the above components to a solvent is formed. Then, the formed coating film is dried, and, as necessary, is heated.

Examples of the solvent used in the preparation of the coating liquid for forming an undercoat layer include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples of these solvents include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing the metal oxide particles when the coating liquid for forming an undercoat layer is prepared include known methods using a roller mill, a ball mill, a vibratory ball mill, an attritor, a sand mill, a colloid mill, a paint shaker, or the like.

Examples of a method for applying the coating liquid for forming an undercoat layer onto the electroconductive substrate include common methods such as a blade coating method, a wire-bar coating method, a spray coating method, a dip coating method, a bead coating method, an air knife coating method, and a curtain coating method.

The film thickness of the undercoat layer is, for example, set to be in a range of preferably equal to or more than 15 μm, more preferably from 15 μm to 50 μm, further preferably from 15 μm to 30 μm, and particularly preferably from 20 μm to 25 μm.

Intermediate Layer

Although not illustrated, an intermediate layer may further be provided between the undercoat layer and the photosensitive layer.

The intermediate layer is a layer which contains a resin, for example. Examples of the resin used in the intermediate layer include polymeric compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer which contains an organic metal compound. Examples of the organic metal compound used in the intermediate layer include those that contain metal atoms such as zirconium, titanium, aluminum, manganese, and silicon.

These compounds used in the intermediate layer may be used singly or as a mixture or a polycondensate of plural kinds of the compounds.

Among these materials, the intermediate layer is preferably a layer which contains an organic metal compound containing a zirconium atom or a silicon atom.

A technique for forming the intermediate layer is not particularly limited, and known methods are used. For example, a coating film for a coating liquid for forming an intermediate layer, which is obtained by adding the above components to a solvent is formed. Then, the formed coating film is dried, and, if necessary, is heated.

As a coating method used for forming the intermediate layer, common methods such as a dip coating method, an extrusion coating method, a wire bar coating method, a spray coating method, a blade coating method, a knife coating method, and a curtain coating method are used.

The film thickness of the intermediate layer is preferably set to in a range of from 0.1 μm to 3 μm, for example. The intermediate layer may be used as the undercoat layer.

Charge Generation Layer

The charge generation layer is a layer including, for example, a charge generating material and a binder resin. Further, the charge generation layer may be a vapor-deposited layer of a charge generating material. The vapor-deposited layer of a charge generating material is suitable in the case where an incoherent light source such as a Light Emitting Diode (LED) or an Organic Electro-Luminescence (EL) image array is used.

Examples of the charge generating material include azo pigments such as bisazo and trisazo pigments, fused aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment is preferably used as a charge generating material in order to be compatible with laser exposure in a near-infrared region. Specifically, for example, hydroxygallium phthalocyanine; chlorogallium phthalocyanine; dichlorotin phthalocyanine; and titanyl phthalocyanine are more preferable.

In order to be compatible with laser exposure in a near-ultraviolet region, fused aromatic pigments such as dibromoanthanthrone; thioindigo pigments; porphyrazine compounds; zinc oxide; trigonal selenium, bisazo pigments are preferable as the charge generating material.

The charge generating materials may be used even in the case where an incoherent light source such as an organic EL image array or an LED having a center wavelength for light emission within the range from 450 nm to 780 nm is used. However, when the photosensitive layer is designed as a thin film having a thickness of equal to or less than 20 μm from the viewpoint of resolution, the electric field strength in the photosensitive layer increases and electrification obtained from charge injection from the electroconductive substrate decreases, thereby readily generating image defects referred to a so-called black spot. This phenomenon becomes notable when a charge generating material, such as trigonal selenium or a phthalocyanine pigment, that readily generates dark current in a p-type semiconductor is used.

In contrast, when an n-type semiconductor such as a fused aromatic pigment, a perylene pigment, and an azo pigment is used as the charge generating material, dark current rarely occurs and image defects referred to black spot are prevented even in the case where the photoconductive layer is in the form of a thin film.

Furthermore, whether the material is of an n-type is determined by the polarity of the photocurrent that flows in a commonly used time-of-flight method and the material in which electrons rather than holes easily flow as a carrier is identified as the n-type.

The binder resin used in the charge generation layer may be selected from a wide variety of insulating resins. Further, the binder resin may be selected from organic photoconductive polymers such as poly-N-vinylcarbazole, polyvinylanthracene, polyvinylpyrene, and polysilane.

Examples of the binder resin in the charge generation layer include polyvinyl butyral resins, polyarylate resins (a polycondensate of a bisphenol and a divalent aromatic dicarboxylic acid, and the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "being insulating" herein refers to having a volume resistivity of equal to or more than $10^{13}$ Ω·cm.

The binder resin may be used alone or as a mixture of two or more kinds thereof.

Moreover, the blend ratio of the charge generating material to the binder resin is preferably in the range from 10:1 to 1:10 in terms of weight ratio.

The charge generation layer may include other known additives.

A technique for forming the charge generation layer is not particularly limited, and known forming methods are used. For example, formation of the charge generation layer is carried out by forming a coating film of a coating liquid for forming a charge generation layer in which the components are added to a solvent, and drying the coating film, followed by heating, as desired. Further, formation of the charge generation layer may be carried out by vapor deposition of the charge generating materials. Formation of the charge generation layer by vapor deposition is particularly suitable in the case where a fused aromatic pigment or a perylene pigment is used as the charge generating material.

Examples of the solvent for preparing the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more kinds thereof.

For a method for dispersing particles (for example, charge generating materials) in the coating liquid for forming a charge generation layer, media dispersers such as a ball mill, a vibratory ball mill, an attritor, a sand mill, and a horizontal sand mill or a medialess disperser such as a stirrer, an ultrasonic disperser, a roller mill, and a high-pressure homogenizer are used. Examples of the high-pressure homogenizer include a collision-type homogenizer in which dispersing is performed by subjecting the dispersion to liquid-liquid collision or liquid-wall collision in a high-pressure state and a penetration-type homogenizer in which dispersing is performed by causing the dispersion to penetrate fine channels in a high pressure state.

Incidentally, during the dispersion, it is effective to adjust the average particle diameter of the charge generating material in the coating liquid for forming a charge generation layer to equal to or less than 0.5 μm, preferably equal to or less than 0.3 μm, and more preferably equal to or less than 0.15 μm.

Examples of the method for applying the undercoat layer (or the intermediate layer) with the coating liquid for forming a charge generation layer include common methods such as a blade coating method, a wire bar coating method, a spray coating method, a dip coating method, a bead coating method, an air knife coating method, and a curtain coating method.

The film thickness of the charge generation layer is set to be, for example, preferably in the range from 0.1 μm to 5.0 μm, and more preferably in the range from 0.2 μm to 2.0 μm.

Charge Transport Layer

The charge transport layer is, for example, a layer which contains a charge transporting material and a binder resin. The charge transport layer may be a layer which contains a charge transporting polymer material.

Examples of the charge transporting material include electron transporting compounds which include, for example, a quinone compound such as p-benzoquinone, chloranil, bromanil, and anthraquinone; a tetracyanoquinodimethane compound; a fluorenone compound such as 2,4,7-trinitrofluorenone; a xanthone compound; a benzophenone compound; a cyanovinyl compound; and an ethylene compound. Examples of the charge transporting material also include hole transporting material such as a triarylamine compound, a benzidine compound, an arylalkane compound, an aryl substituted ethylene compound, a stilbene compound, an anthracene compound, and a hydrazone compound. The charge transporting material is used singly or in combination of two or more types, and it is not limited thereto.

From a viewpoint of charge mobility, triarylamine derivatives represented by the following formula (a-1) and benzidine derivatives represented by the following formula (a-2) are preferable as the charge transporting material.

(a-1)

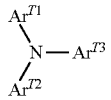

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T5})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

As a substituent of each of the groups, a halogen atom, an alkyl group having from 1 to 5 carbon atoms, and an alkoxy group having from 1 to 5 carbon atoms are exemplified. As a substituent of each of the groups, a substituted amino group which has been substituted with an alkyl group having from 1 to 3 carbon atoms is also exemplified.

(a-2)

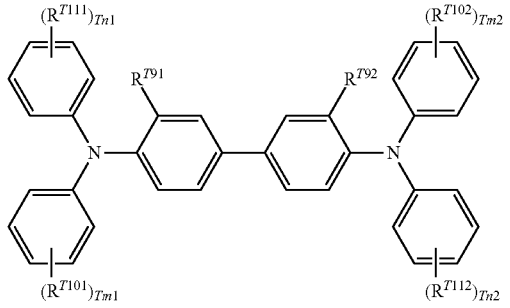

In the formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T103}$, and $R^{T112}$ each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$, and $R^{T16}$ each independently represent a hydrogen atom, a substituted or unsubstituted alkyl group, a substituted or unsubstituted aryl group. Tm1, Tm2, Tn1, and Tn2 each independently represent an integer of from 0 to 2.

As a substituent of each of the groups, a halogen atom, an alkyl group having from 1 to 5 carbon atoms, and an alkoxy group having from 1 to 5 carbon atoms are exemplified. As a substituent of each of the groups, a substituted amino group which has been substituted with an alkyl group having from 1 to 3 carbon atoms is also exemplified.

Here, among triarylamine derivatives represented by the formula (a-1) and benzidine derivatives represented by the formula (a-2), particularly, triarylamine derivative having "$—C_6H_4—CH=CH—CH=C(R^{T7})(R^{T8})$", and benzidine derivative having "$—CH=CH—CH=C(R^{T15})(R^{T16})$" are preferable from a viewpoint of the charge mobility.

From a viewpoint of charge mobility, examples of the charge transporting material preferably include a butadiene charge transporting material (CT1) represented by the following formula (CT1).

(CT1)

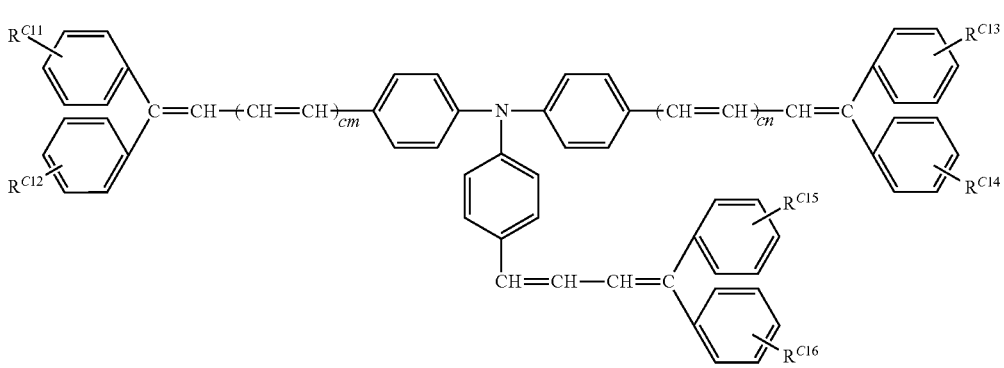

In the formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having from 1 to 20 carbon atoms, an alkoxy group having from 1 to 20 carbon atoms, or an aryl group having from 6 to 30 carbon atoms, and two adjacent substituents may be bonded to each other to form a hydrocarbon ring structure.

cm and cn each independently represent 0, 1, or 2.

In the formula (CT1), examples of the halogen atoms represented by $R^{C11}$, $R^{C12}$, $R^{C13}$, $R^{C14}$, $R^{C15}$, and $R^{C16}$ include a fluorine atom, a chlorine atom, a bromine atom, and an iodine atom. Among these, as the halogen atom, a fluorine atom and a chlorine atom are preferable, and a chlorine atom is more preferable.

In the formula (CT1), examples of the alkyl groups represented by $R^{C11}$, $R^{C12}$, $R^{C13}$, $R^{C14}$, $R^{C15}$, and $R^{C16}$ include a linear or branched alkyl group having from 1 to 20 carbon atoms (preferably having from 1 to 6 carbon atoms, and more preferably having from 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, a n-decyl group, a n-undecyl group, a n-dodecyl group, a n-tridecyl group, a n-tetradecyl group, a n-pentadecyl group, a n-hexadecyl group, a n-heptadecyl group, a n-octadecyl group, a n-nonadecyl group, and a n-eicosyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoeicosyl group, a sec-eicosyl group, a tert-eicosyl group, and a neoeicosyl group.

Among these, lower alkyl groups such as a methyl group, an ethyl group, and an isopropyl group are preferable as the alkyl group.

In the formula (CT1), examples of the alkoxy groups represented by $R^{C11}$, $R^{C12}$, $R^{C13}$, $R^{C14}$, $R^{C15}$, and $R^{C16}$ include a linear or branched alkoxy group having from 1 to 20 carbon atoms (preferably having from 1 to 6 carbon atoms, and more preferably having from 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, a n-decyloxy group, a n-undecyloxy group, a n-dodecyloxy group, a n-tridecyloxy group, a n-tetradecyloxy group, a n-pentadecyloxy group, a n-hexadecyloxy group, a n-heptadecyloxy group, a n-octadecyloxy group, a n-nonadecyloxy group, and a n-eicosyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoeicosyloxy group, a sec-eicosyloxy group, a tert-eicosyloxy group, and a neoeicosyloxy group.

Among these, a methoxy group is preferable as the alkoxy group.

In the formula (CT1), examples of the aryl groups represented by $R^{C11}$, $R^{C12}$, $R^{C13}$, $R^{C14}$, $R^{C15}$, and $R^{C16}$ include an aryl group having from 6 to 30 carbon atoms (preferably having from 6 to 20 carbon atoms, and more preferably having from 6 to 16 carbon atoms).

Specific examples of the aryl group include a phenyl group, a naphthyl group, a phenanthryl group, and a biphenylyl group.

Among these, a phenyl group and a naphthyl group are preferable as the aryl group.

Furthermore, in the formula (CT1), the respective substituents represented by $R^{C11}$, $R^{C12}$, $R^{C13}$, $R^{C14}$, $R^{C15}$, and $R^{C16}$ also include groups further having substituents. Examples of the substituents include atoms and groups exemplified above (for example, a halogen atom, an alkyl group, an alkoxy group, and an aryl group).

In the formula (CT1), examples of the groups linking the substituents in the hydrocarbon ring structures in which two adjacent substituents (for example, $R^{C11}$ and $R^{C12}$, $R^{C13}$ and $R^{C14}$, and $R^{C15}$ and $R^{C16}$) of $R^{C11}$, $R^{C12}$, $R^{C13}$, $R^{C14}$, $R^{C15}$, and $R^{C16}$ are linked to each other include a single bond, a 2,2'-methylene group, a 2,2'-ethylene group, and a 2,2'-vinylene group, and among these, a single bond and a 2,2'-methylene group are preferable.

Here, specific examples of the hydrocarbon ring structure include a cycloalkane structure, a cycloalkene structure, and a cycloalkanepolyene structure.

In the formula (CT1), cm and cn are preferably 1.

In the formula (CT1), from the viewpoint of forming a photosensitive layer having high charge transportability (the charge transport layer), it is preferable that $R^{C11}$, $R^{C12}$, $R^{C13}$, $R^{C14}$, $R^{C15}$, and $R^{C16}$ each represent a hydrogen atom, an alkyl group having from 1 to 20 carbon atoms, or an alkoxy group having from 1 to 20 carbon atoms, and cm and cn each represent 1 or 2, and it is more preferable that $R^{C11}$, $R^{C12}$, $R^{C13}$, $R^{C14}$, $R^{C15}$, and $R^{C16}$ each represent a hydrogen atom, and cm and cn each represent 1.

That is, it is more preferable that the butadiene charge transport material (CT1) is a charge transport material (exemplary compound (CT1-3)) represented by the following formula (CT1A).

(CT1A)

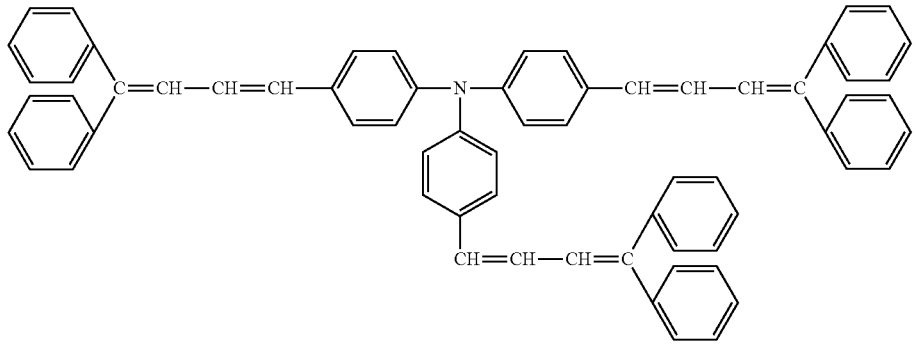

Specific examples of the butadiene charge transport material (CT1) are shown below, and are not limited thereto.

| Exemplary Compound No. | cm | cn | $R^{C11}$ | $R^{C12}$ | $R^{C13}$ | $R^{C14}$ | $R^{C15}$ | $R^{C16}$ |
|---|---|---|---|---|---|---|---|---|
| CT1-1 | 1 | 1 | 4-$CH_3$ | 4-$CH_3$ | 4-$CH_3$ | 4-$CH_3$ | H | H |
| CT1-2 | 2 | 2 | H | H | H | H | 4-$CH_3$ | 4-$CH_3$ |
| CT1-3 | 1 | 1 | H | H | H | H | H | H |
| CT1-4 | 2 | 2 | H | H | H | H | H | H |
| CT1-5 | 1 | 1 | 4-$CH_3$ | 4-$CH_3$ | 4-$CH_3$ | H | H | H |
| CT1-6 | 0 | 1 | H | H | H | H | H | H |
| CT1-7 | 0 | 1 | 4-$CH_3$ | 4-$CH_3$ | 4-$CH_3$ | 4-$CH_3$ | 4-$CH_3$ | 4-$CH_3$ |
| CT1-8 | 0 | 1 | 4-$CH_3$ | 4-$CH_3$ | H | H | 4-$CH_3$ | 4-$CH_3$ |
| CT1-9 | 0 | 1 | H | H | 4-$CH_3$ | 4-$CH_3$ | H | H |
| CT1-10 | 0 | 1 | H | H | 3-$CH_3$ | 3-$CH_3$ | H | H |
| CT1-11 | 0 | 1 | 4-$CH_3$ | H | H | H | 4-$CH_3$ | H |
| CT1-12 | 0 | 1 | 4-$OCH_3$ | H | H | H | 4-$OCH_3$ | H |
| CT1-13 | 0 | 1 | H | H | 4-$OCH_3$ | 4-$OCH_3$ | H | H |
| CT1-14 | 0 | 1 | 4-$OCH_3$ | H | 4-$OCH_3$ | H | 4-$OCH_3$ | 4-$OCH_3$ |
| CT1-15 | 0 | 1 | 3-$CH_3$ | H | 3-$CH_3$ | H | 3-$CH_3$ | H |
| CT1-16 | 1 | 1 | 4-$CH_3$ | 4-$CH_3$ | 4-$CH_3$ | 4-$CH_3$ | 4-$CH_3$ | 4-$CH_3$ |
| CT1-17 | 1 | 1 | 4-$CH_3$ | 4-$CH_3$ | H | H | 4-$CH_3$ | 4-$CH_3$ |
| CT1-18 | 1 | 1 | H | H | 4-$CH_3$ | 4-$CH_3$ | H | H |
| CT1-19 | 1 | 1 | H | H | 3-$CH_3$ | 3-$CH_3$ | H | H |
| CT1-20 | 1 | 1 | 4-$CH_3$ | H | H | H | 4-$CH_3$ | H |
| CT1-21 | 1 | 1 | 4-$OCH_3$ | H | H | H | 4-$OCH_3$ | H |
| CT1-22 | 1 | 1 | H | H | 4-$OCH_3$ | 4-$OCH_3$ | H | H |
| CT1-23 | 1 | 1 | 4-$OCH_3$ | H | 4-$OCH_3$ | H | 4-$OCH_3$ | 4-$OCH_3$ |
| CT1-24 | 1 | 1 | 3-$CH_3$ | H | 3-$CH_3$ | H | 3-$CH_3$ | H |

Furthermore, the abbreviated symbols in the exemplary compounds represent the following meanings. Further, the numbers attached before the substituents represent the substitution positions with respect to the benzene ring.

—$CH_3$: Methyl group

—$OCH_3$: Methoxy group

The butadiene charge transport material (CT1) may be used alone or in combination of two or more kinds thereof.

As the charge transport material, the benzidine charge transport material (CT2) represented by the following formula (CT2) is preferable from a viewpoint of the charge mobility. From a viewpoint of the charge mobility, it is preferable to use the butadiene charge transport material (CT1) and the benzidine charge transport material (CT2) in combination.

(CT2)

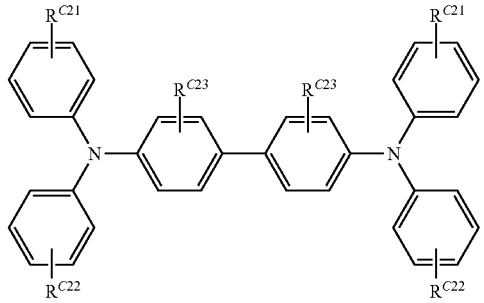

In the formula (CT2), $R^{C21}$, $R^{C22}$, and $R^{C23}$ each, independently represent a hydrogen atom, a halogen atom, an alkyl group having from 1 to 10 carbon atoms, an alkoxy group having from 1 to 10 carbon atoms, or an aryl group having from 6 to 10 carbon atoms.

In the formula (CT2), examples of the halogen atoms represented by $R^{C21}$, $R^{C22}$, and $R^{C23}$ include a fluorine atom, a chlorine atom, a bromine atom, and an iodine atom. Among these, as the halogen atom, a fluorine atom and a chlorine atom are preferable, and a chlorine atom is more preferable.

In the formula (CT2), examples of the alkyl groups represented by $R^{C21}$, $R^{C22}$, and $R^{C23}$ include a linear or branched alkyl group having from 1 to 10 carbon atoms (preferably having from 1 to 6 carbon atoms, and more preferably having from 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, and a n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups such as a methyl group, an ethyl group, and an isopropyl group are preferable as the alkyl group.

In the formula (CT2), examples of the alkoxy groups represented by $R^{C21}$, $R^{C22}$, and $R^{C23}$ include a linear or branched alkoxy group having from 1 to 10 carbon atoms (preferably having from 1 to 6 carbon atoms, and more preferably having from 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, and a n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, a methoxy group is preferable as the alkoxy group.

In the formula (CT2), examples of the aryl groups represented by $R^{C21}$, $R^{C22}$, and $R^{C23}$ include an aryl group having from 6 to 10 carbon atoms (preferably having from 6 to 9 carbon atoms, and more preferably having from 6 to 8 carbon atoms).

Specific examples of the aryl group include a phenyl group and a naphthyl group.

Among these, a phenyl group is preferable as the aryl group.

Moreover, in the formula (CT2), the respective substituents represented by $R^{C21}$, $R^{C22}$, and $R^{C23}$ also include groups further having substituents. Examples of the substituents include atoms and groups exemplified above (for example, a halogen atom, an alkyl group, an alkoxy group, and an aryl group).

In the formula (CT2), particularly from the viewpoint of forming a photosensitive layer having high charge transportability (the charge transport layer)(for high sensitivity of the photoreceptor), it is preferable that $R^{C21}$, $R^{C22}$, and $R^{C23}$ each independently represent a hydrogen atom or an alkyl group having from 1 to 10 carbon atoms, and it is more preferable that $R^{C21}$ and $R^{C23}$ represent a hydrogen atom, and $R^{C22}$ represents an alkyl group having from 1 to 10 carbon atoms (particularly a methyl group).

Specifically, it is particularly preferable that the benzidine charge transport material (CT2) is a charge transport material (exemplary compound (CT2-2)) represented by the following formula (CT2A).

(CT2A)

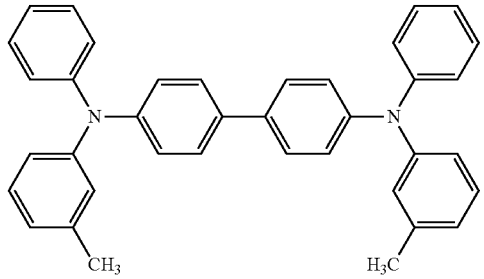

Specific examples of the benzidine charge transport material (CT2) are shown below, and are not limited thereto.

| Exemplary Compound No. | $R^{C21}$ | $R^{C22}$ | $R^{C23}$ |
|---|---|---|---|
| CT2-1 | H | H | H |
| CT2-2 | H | 3-$CH_3$ | H |
| CT2-3 | H | 4-$CH_3$ | H |
| CT2-4 | H | 3-$C_2H_5$ | H |
| CT2-5 | H | 4-$C_2H_5$ | H |
| CT2-6 | H | 3-$OCH_3$ | H |
| CT2-7 | H | 4-$OCH_3$ | H |
| CT2-8 | H | 3-$OC_2H_5$ | H |
| CT2-9 | H | 4-$OC_2H_5$ | H |
| CT2-10 | 3-$CH_3$ | 3-$CH_3$ | H |
| CT2-11 | 4-$CH_3$ | 4-$CH_3$ | H |
| CT2-12 | 3-$C_2H_5$ | 3-$C_2H_5$ | H |
| CT2-13 | 4-$C_2H_5$ | 4-$C_2H_5$ | H |
| CT2-14 | H | H | 2-$CH_3$ |
| CT2-15 | H | H | 3-$CH_3$ |
| CT2-16 | H | 3-$CH_3$ | 2-$CH_3$ |
| CT2-17 | H | 3-$CH_3$ | 3-$CH_3$ |
| CT2-18 | H | 4-$CH_3$ | 2-$CH_3$ |
| CT2-19 | H | 4-$CH_3$ | 3-$CH_3$ |
| CT2-20 | 3-$CH_3$ | 3-$CH_3$ | 2-$CH_3$ |
| CT2-21 | 3-$CH_3$ | 3-$CH_3$ | 3-$CH_3$ |
| CT2-22 | 4-$CH_3$ | 4-$CH_3$ | 2-$CH_3$ |
| CT2-23 | 4-$CH_3$ | 4-$CH_3$ | 3-$CH_3$ |

Furthermore, the abbreviated symbols in the exemplary compounds represent the following meanings. Further, the numbers attached before the substituents represent the substitution positions with respect to the benzene ring.

—$CH_3$: Methyl group

—$C_2H_5$: Ethyl group

—$OCH_3$: Methoxy group

—$OC_2H_5$: Ethoxy group

The benzidine charge transport material (CT2) may be used alone or in combination of two or more kinds thereof.

As the charge transporting polymer material, known materials having charge transporting properties, such as poly-N-vinylcarbazole and polysilane are used. In particular, a polyester charge transporting polymer material is particularly preferable. The charge transporting polymer material may be singly used, or may be used along with a binder resin.

Examples of the binder resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins or polyarylate resins are suitable as the binder resin. These binder resins may be used alone or in combination of two or more kinds thereof.

In addition, the blend ratio of the charge transport material to the binder resin is preferably from 10:1 to 1:5 in terms of weight ratio.

The charge transport layer may contain other known additives.

A technique for forming the charge transport layer is not particularly limited, and known forming methods are used. For example, formation of the charge transport layer is carried out by forming a coating film of a coating liquid for forming a charge transport layer, prepared by adding the components to a solvent, and then drying the coating film, followed by heating as desired.

Examples of the solvent for preparing the coating liquid for forming a charge transport layer are common organic solvents including, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or as a mixture of two or more kinds thereof.

Examples of a coating method used in coating the charge generation layer with the coating liquid for forming a charge transport layer include common methods such as a blade coating method, a wire bar coating method, a spray coating method, a dip coating method, a bead coating method, an air knife coating method, and a curtain coating method.

The film thickness of the charge transport layer is, for example, set to be in the range from preferably 5 μm to 50 μm and more preferably from 10 μm to 30 μm.

Protective Layer

The protective layer is provided on the photosensitive layer, as desired. The protective layer is provided, for example, for the purpose of preventing the chemical changes of the photosensitive layer during charging, and further improving the mechanical strength of the photosensitive layer.

Accordingly, as the protective layer, a layer formed of a cured film (crosslinked film) may be applied. Examples of this layer include the layers described in 1) and 2) below.

1) A layer formed of a cured film of a composition that includes a reactive group-containing charge transport material that has a reactive group and a charge transporting skeleton in the same molecule (that is, a layer that includes a polymer or a crosslinked product of the reactive group-containing charge transport material)

2) A layer formed of a cured film of a composition that includes an unreactive charge transport material and a reactive group-containing non-charge transport material that has no charge transporting skeleton but has a reactive group (that is, a layer that includes a polymer or a crosslinked product of an unreactive charge transport material and a reactive group-containing non-charge transport material).

Examples of the reactive group of the reactive group-containing charge transport material include known reactive groups such as a chain polymerizable group, an epoxy group, —OH, —OR [in which R represents an alkyl group], —$NH_2$, —SH, —COOH, and —$SiR^{Q1}{}_{3-Qn}(OR^{Q2})_{Qm}$ [in which $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of from 1 to 3].

The chain polymerizable group is not particularly limited as long as it is a radically polymerizable functional group. For example, it is a functional group which has at least a group containing a carbon-carbon double bond. Specific examples thereof include a group that contains at least one selected from the group consisting of a vinyl group, a vinyl ether group, a vinyl thioether group, a vinylphenyl group, an acryloyl group, a methacryloyl group, and derivatives thereof. Among these, a group that contains at least one selected from the group consisting of a vinyl group, a vinylphenyl group, an acryloyl group, a methacryloyl group, and derivatives thereof is preferable as the chain polymerizable group from the viewpoint of its excellent reactivity.

The charge transporting skeleton of the reactive group-containing charge transport material is not particularly limited as long as it is a known structure for an electrophotographic photoreceptor. Examples thereof include skeletons derived from nitrogen-containing hole transport compounds such as triarylamine compounds, benzidine compounds, and hydrazone compounds, in which the structure is conjugated with a nitrogen atom. Among these, a triarylamine skeleton is preferable.

The reactive group-containing charge transport material having a reactive group and a charge transporting skeleton, the unreactive charge transport material, and the reactive group-containing non-charge transport material may be selected from known materials.

The protective layer may further include other known additives.

A technique for forming the protective layer is not particularly limited, and known methods are used. For example, the formation is carried out by forming a coating film from a coating liquid for forming a protective layer, prepared by adding the components to a solvent, and drying the coating film, followed by a curing treatment such as heating, as desired.

Examples of the solvent used for preparing the coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents may be used alone or as a mixture of two or more kinds thereof.

Furthermore, the coating liquid for forming a protective layer may be a solvent-free coating liquid.

Examples of the coating method used for coating the photosensitive layer (for example, the charge transport layer) with the coating liquid for forming a protective layer include common methods such as a dip coating method, a lift coating method, a wire bar coating method, a spray coating method, a blade coating method, a knife coating method, and a curtain coating method.

The film thickness of the protective layer is set to be, for example, preferably in the range from 1 μm to 20 μm, and more preferably in the range from 2 μm to 10 μm.

Single-Layer Type Photosensitive Layer

The single-layer type photosensitive layer (charge generation/charge transport layer) is a layer which contains, for example, a charge generating material, a charge transporting material, and, if necessary, a binder resin and other well-known additives. These materials are similar to the materials described for the charge generation layer and the charge transport layer.

The content of the charge generating material in the single-layer type photosensitive layer may be from 10% by weight to 85% by weight, with respect to the total solid content. The content of the charge generating material is preferably from 20% by weight to 50% by weight. The content of the charge transporting material in the single-layer type photosensitive layer may be from 5% by weight to 50% by weight with respect to the total solid content.

A forming method of the single-layer type photosensitive layer is similar to the forming method of the charge generation layer or the charge transport layer.

The film thickness of the single-layer type photosensitive layer may be, for example, from 5 μm to 50 μm. The film thickness of the single-layer type photosensitive layer is preferably from 10 μm to 40 μm.

Charging Device

The charging device (an example of the charging unit) 15 charges the surface of the photoreceptor 7. The charging device 15 is configured to include, for example, a power source (an example of a voltage applying unit for a charging member) 28 which applies a charging potential to a charging member 14 for charging the surface of the photoreceptor 7. The power source 28 is electrically connected to the charging member 14.

The charging member 14 of the charging device 15 is provided, for example, in a manner of contact or non-contact with the surface of the photoreceptor 7. Examples of the charging member 14 include a contact type charger which uses a conductive charging roller, a charging brush, a charging film, a charging rubber blade, a charging tube, or the like is used. Further, for example, known chargers such as a roller charger of a non-contact charging type, a scorotron charger or a corotron charger using corona discharge are also exemplified.

The charging device (including the power source 28) 15 is electrically connected to, for example, a control device 36 provided in the image forming apparatus 10. The charging device 15 drives by a control of the control device 36, so as to apply a charging voltage to the charging member 14. The charging member 14 to which the charging voltage has been applied from the power source 28 charges the photoreceptor 7 so as to have a charging potential depending on the applied charging voltage. Thus, adjusting the charging voltage applied from the power source 28 causes the photoreceptor 7 to be charged so as to have various charging potentials.

Electrostatic Latent Image Forming Device

The electrostatic latent image forming device (exposure device) (an example of the electrostatic latent image forming unit) 16 forms an electrostatic latent image on the charged surface of the photoreceptor 7.

Specifically, for example, the electrostatic latent image forming device 16 is electrically connected to the control device 36 provided in the image forming apparatus 10. The electrostatic latent image forming device 16 drives by a control of the control device 36, so as to expose the surface of the photoreceptor 7 which has been charged by the charging member 14. The exposure is performed to light L which has been modulated based on image information of an image to be formed. The electrostatic latent image forming device 16 forms an electrostatic latent image corresponding to an image of image information, on the photoreceptor 7. The exposed surface of the photoreceptor has a potential-after-exposure in accordance with intensity of exposing light of the electrostatic latent image forming device.

Examples of the electrostatic latent image forming device 16 include an exposure device such as an optical instrument which performs exposure to light such as semiconductor laser light, light emitting diode (LED) light, liquid crystal shutter light or the like, in an imagewise manner. The wavelength of the light source may be in a spectral sensitivity region of the electrophotographic photoreceptor 7. For the wavelength of the semiconductor laser light, for example, the near-infrared ray having an emission wavelength at near 780 nm may be used. However, the wavelength of the light source is not limited to this wavelength. A laser having a wavelength in the band of 600 nm, or a blue laser having a wavelength from 400 nm to 450 nm may also be used. As the electrostatic latent image forming device 16, a surface light-emitting type laser light source that may output multiple beams is also available for color image formation, for example.

Developing Device

The developing device 18 is provided, for example, on a downstream side of an application position of light L by the electrostatic latent image forming device 16, in the rotation direction of the photoreceptor 7. A storing unit that stores a developer is provided in the developing device 18.

The developer stored in the developing device 18 may be a single-component developer configured by a toner alone, or a two-component developer that includes a toner and a carrier. The developer may be magnetic or nonmagnetic.

The developing device 18 is configured to include, for example, a developing member 18A and a power source (an example of a voltage applying unit for a developing member) 32. The developing member 18A develops the electrostatic latent image formed on the surface of the photoreceptor 7, by using a developer containing a toner. The power source 32 applies a developing voltage to the developing member 18A. The developing member 18A is electrically connected to the power source 32, for example.

The developing member 18A of the developing device 18 may be selected in accordance with the type of the developer. Examples of the developing member 18A include a developing roller which has a developing sleeve in which a magnet is provided.

The developing device (including the power source 32) 18 is electrically connected to the control device 36 provided in the image forming apparatus 10, for example. The developing device 18 drives by a control of the control device 36, so as to apply a developing voltage to the developing member 18A. The developing member 18A to which the developing voltage has been applied from the power source 32 is charged so as to have a developing potential which depends on the applied developing voltage.

The developing member 18A charged so as to have the developing potential holds the developer stored in, for example, the developing device 18, on the surface of the developing member 18A. The developing member 18A supplies the toner contained in the developer, to the surface of the photoreceptor 7 from the developing device 18.

The toner supplied onto the photoreceptor 7 adheres to, for example, the electrostatic latent image on the photoreceptor 7 by an electrostatic force. In detail, for example, a potential difference in a region in which the photoreceptor 7 and the developing member 18A face each other, that is, a potential difference between a potential of the surface of the photoreceptor 7 and the developing potential of the developing member 18A in this region causes the toner contained in the developer to be supplied to a region of the photoreceptor 7, in which the electrostatic latent image has been formed. In a case where the developer contains a carrier, the carrier is brought back into the developing device 18 in a state of being held in the developing member 18A.

Thus, for example, the electrostatic latent image on the photoreceptor 7 is developed by the toner supplied from the developing member 18A. Thus, a toner image corresponding to the electrostatic latent image is formed on the photoreceptor 7.

The toner and the developer will be described in more detail later.

Transfer Device. The transfer device (an example of a transfer unit) 31 is provided, for example, on a downstream side of a position of the developing member 18A, in the rotation direction of the photoreceptor 7.

The transfer device 31 is configured to include, for example, a transfer member 20 and a power source (an example of a voltage applying unit for a transfer member) 30. The transfer member 20 transfers the toner image formed on the surface of the photoreceptor 7, to paper (an example of a recording medium) P. The power source 30 applies a transfer voltage to the transfer member 20. The transfer member 20 is, for example, columnar. The transfer member 20 rotates in a direction indicated by an arrow C, and transports the paper P interposed between the transfer member 20 and the photoreceptor 7. The transfer member 20 is electrically connected to the power source 30, for example.

Examples of the transfer member 20 in the transfer device 31 include a contact-type transfer charger using a belt, a roller, a film, a rubber blade, or the like, and known non-contact type transfer chargers such as scorotron transfer chargers and corotron transfer chargers, each utilizing corona discharge.

The transfer device (including the power source 30) 31 is electrically connected to the control device 36 provided in the image forming apparatus 10, for example. The transfer device 31 drives by a control of the control device 36, so as to apply a transfer voltage to the transfer member 20. The transfer member 20 to which the transfer voltage is applied from the power source 32 is charged so as to have a transfer potential depending on the applied transfer voltage.

If the transfer voltage having a polarity opposite to that of the toner constituting the toner image which has been formed on the photoreceptor 7 is applied to the transfer member 20 from the power source 30 of the transfer member 20, an electric field is formed, for example, in a region (in FIG. 1, see a transfer region T) in which the photoreceptor 7 and the transfer member 20 face each other. The formed electric field has field strength as strong as that the toner constituting the toner image on the photoreceptor 7 is moved from the photoreceptor 7 to the transfer member 20 side by an electrostatic force.

The paper (an example of a recording medium) P is stored, for example, in a storing unit of which illustration is omitted. The paper P is transported from the storing unit on a transporting path 34 by plural transporting members of which illustrations are omitted. Then, the paper P reaches the transfer region T which is the region in which the photoreceptor 7 and the transfer member 20 face each other. In the example illustrated in FIG. 1, the paper is transported in a direction indicated by an arrow B. For example, a transfer electric field formed in this region by applying the transfer voltage to the transfer member 20 causes the toner image on the photoreceptor 7 to be transferred to the paper P which has reached the transfer region T. That is, for example, the toner is moved from the surface of the photoreceptor 7 to the paper P, and thus the toner image is transferred onto the paper P.

The toner image on the photoreceptor 7 is transferred onto the paper P by the transfer electric field. Strength of the transfer electric field is controlled based on a transfer current value.

Here, "the transfer current value" indicates a current value of the transfer current which flows into the photoreceptor from the transfer unit when a toner image is transferred to a recording medium from the photoreceptor.

The transfer current value is preferably from 20 μA to 100 μA, and more preferably from 30 μA to 80 μA, from a viewpoint of achieving prevention of poor transfer and prevention of the occurrence of ghost.

Recharging Device

The recharging device (an example of a recharging unit) 40 charges the electrophotographic photoreceptor after the toner image has been directly transferred onto the surface of the recording medium. The recharging device 40 is configured to include, for example, a power source (not illustrated) for applying the charging potential to a recharging member 40A. The power source (not illustrated) is electrically connected to the recharging member 40A, for example.

The recharging member 40A of the recharging device 40 is provided so as not to be in contact with the surface of the photoreceptor 7. Examples of the recharging member 40A include known chargers such as a roller charger of a non-contact charging type, a scorotron charger or a corotron charger using corona discharge.

The recharging device 40 is electrically connected to the control device 36 provided in the image forming apparatus 10, for example. The recharging device 40 drives by a control of the control device 36, so as to apply a charging voltage to the recharging member 40A. The voltage to be applied may be a DC voltage. The recharging member 40A to which the charging voltage is applied from a power source (not illustrated) charges the surface of the photoreceptor 7 so as to have the charging potential depending on the applied charging voltage, after the toner image has been transferred to the paper P.

The recharging device 40 is charged so as to have the same polarity as the charging device 15. For example, the recharging device 40 charges the photoreceptor 7, and thus charges accumulated in the photoreceptor 7 by the transfer device 31 are cancelled. The recharging device 40 charges the photoreceptor 7, and thus charging of the residual toner remaining on the surface of the photoreceptor 7 is easily controlled. Thus, the residual toner is easily recollected by the cleaning device 22, for example.

Cleaning Device

The cleaning device (an example of a cleaning unit) 22 is provided on the downstream side of the transfer region T in the rotation direction of the photoreceptor 7.

The cleaning device 22 removes matters adhered to the photoreceptor 7, after the toner image has been transferred to the paper P (that is, the cleaning device 22 performs cleaning of the surface of the photoreceptor 7).

The cleaning device 22 removes the adhesive matters such as the residual toner or paper powder on the photoreceptor 7. The cleaning device 22 may have, for example, a configuration in which a cleaning blade 22A which contacts with the photoreceptor 7 at predetermined linear pressure is provided. The cleaning blade 22A may contact with the photoreceptor 7 at linear pressure of from 10 g/cm to 150 g/cm, for example.

Erasing Device

The erasing device (an example of an erasing unit) 24 is provided, for example, on a downstream side of the cleaning device 22 in the rotation direction of the photoreceptor 7.

The erasing device 24 exposes the surface of the photoreceptor 7 so as to perform erasing, after the toner image has been transferred.

Specifically, for example, the erasing device 24 is electrically connected to the control device 36 provided in the image forming apparatus 10. The erasing device 24 drives by a control of the control device 36, and thus exposes the entirety (specifically, for example, the entire surface of an image-forming region) of the surface of the photoreceptor 7 so as to perform erasing.

Examples of the erasing device 24 include a device which includes a light source such as a tungsten lamp for irradiation with white light, and a light-emitting diode (LED) for irradiation with red light.

Fixing Device

The fixing device (an example of a fixing unit) 26 is provided, for example, on the transporting path 34 of the paper P on a downstream side of the transfer region T in a transport direction of the paper P.

The fixing device 26 fixes the toner image transferred onto the paper P, for example.

Specifically, for example, the fixing device 26 is electrically connected to the control device 36 provided in the image forming apparatus 10. The fixing device 26 drives by a control of the control device 36, so as to fix the toner image transferred to the paper P, to the paper P by heating or by heating and pressing.

Examples of the fixing device 26 include known fixing machines such as a heat roller fixing machine and an oven fixing machine. FIG. 1 illustrates the heat roller fixing machine which includes a heating roll 26A and a pressure roll 26B disposed so as to face the heating roll 26A.

Here, the paper P to which the toner image has been transferred by being transported on the transporting path 34 and passing through the region (transfer region T) in which the photoreceptor 7 and the transfer member 20 face each other reaches an installation position of the fixing device 26 along the transporting path 34 by the transporting member (illustration is omitted). Thus, the toner image on the paper P is fixed.

The paper P on which an image is formed by fixing the toner image is discharged to the outside of the image forming apparatus 10 by plural transporting members (illustrations will be omitted).

The photoreceptor 7 is charged again by the charging device 15 after erasing by the erasing device 24.

Control Device

The control device 36 is configured as a computer for performing control of the entirety of the apparatus, and for performing various computations. Specifically, the control device 36 includes a central processing unit (CPU), a read only memory (ROM) for storing various programs therein, a random access memory (RAM) used as a work area during execution of a program, a non-volatile memory for storing various types of information, and an input and output interface (I/O). The CPU, the ROM, the RAM, the non-volatile memory, and the I/O are connected to each other through a bus. Each of the units of the image forming apparatus 10, such as the photoreceptor (including the driving motor 27) 7, the charging device (including the power source 28) 15, the electrostatic latent image forming device 16, the developing device (including the power source 32) 18, the transfer device (including the power source 30) 31, the recharging device (including the power source of which illustration is omitted) 40, the erasing device 24, and the fixing device 26 are connected to the I/O.

The CPU executes, for example, a control program of a program (for example, an image forming sequence, a restoration sequence, or the like) stored in the ROM or the non-volatile memory. Thus, the CPU controls operations of the units of the image forming apparatus 10. The RAM is used as a work memory. For example, a program to be executed by the CPU, data required for processing of the CPU, and the like are stored in the ROM or the non-volatile memory. The control program or various types of data may be stored in another storage device such as a storage unit, or may be obtained from the outside of the apparatus through a communication unit.

Various drives may be connected to the control device 36. Examples of the various drives include a device which reads data from a portable medium or writes data in the medium. The medium is computer-readable, and includes a flexible disk, a magneto-optic disk, a CD-ROM, a DVD-ROM, and an universal serial bus (USB) memory. In a case where the various drives are provided, the control program may be recorded in a portable medium, and the recorded control program may be read by the corresponding drive. Thus, the control program may be executed.

Image Forming Operation (Image Formation Method)

An image forming operation of the image forming apparatus 10 will be described.

Firstly, the charging device 15 charges the surface of the photoreceptor 7 (charging unit). The electrostatic latent image forming device 16 exposes the charged surface of the photoreceptor 7, based on image information. Thus, an electrostatic latent image corresponding to the image information is formed on the photoreceptor 7 (electrostatic latent image forming unit). In the developing device 18, an electrostatic latent image formed on the surface of the photoreceptor 7 is developed by the developer containing the toner. Thus, a toner image is formed on the surface of the photoreceptor 7 (developing unit). In the transfer device 31, the toner image formed on the surface of the photoreceptor 7 is transferred to paper P (transferring unit). The toner image which has been transferred to the paper P is fixed by the fixing device 26.

The recharging device 40 recharges the surface of the photoreceptor 7 after the toner image has been transferred. Thus, charges of the opposite polarity accumulated in the photosensitive layer are cancelled. The charging is controlled so as to align the polarity of the residual toner which remains on the surface of the photoreceptor 7. The cleaning device 22 performs cleaning and the erasing device 24 performs erasing.

FIG. 1 illustrates an apparatus which includes an erasing unit which irradiates an erasing light onto the surface of the photoreceptor so as to perform erasing before charging after transfer of the toner image, as the erasing device 24. However, the image forming apparatus according to the exemplary embodiment is not limited to the above configuration.

Regarding the image forming apparatus according to the exemplary embodiment, an apparatus which includes the recharging unit is described as an example. The recharging unit is disposed on the downstream side of the transfer unit after transfer of a toner image, in the rotation direction of the photoreceptor 7, and is disposed on an upstream side of the cleaning unit in the rotation direction of the photoreceptor 7. However, the image forming apparatus according to the exemplary embodiment is not limited to the above configuration.

In the image forming apparatus according to the exemplary embodiment, for example, a part including the photoreceptor 7, and the transfer device 31 may form a cartridge structure (process cartridge) which is detachable from the image forming apparatus. For example, a process cartridge which includes the photoreceptor 7 and the transfer device 31 according to the exemplary embodiment is suitably used as the process cartridge. The process cartridge may include, for example, at least one selected from a group configured from the charging unit, the electrostatic latent image forming unit, the developing unit, and the recharging unit, in addition to the photoreceptor 7.

Toner

A toner (specific toner) used in the image forming apparatus according to the exemplary embodiment will be described below.

The specific toner contains at least toner particles of which at least volume average particle diameter is from 3.0 μm to 5.5 μm. If necessary, the specific toner may additionally contain an external additive.

Toner Particles

The toner particle contains, for example, a binder resin and, if necessary, a coloring agent, a release agent, and other additives.

Binder Resin

Examples of the binder resin include vinyl resin formed from a homopolymer of the following monomers or a copolymer obtained by combination of two or more types of the monomers: styrenes (for example, styrene, parachlorostyrene, and α-methyl styrene), (meta)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, vinyl isopropenyl ketone, and the like), olefins (for example, ethylene, propylene, and butadiene).

Examples of the binder resin include non-vinyl resins such as epoxy resins, polyester resins, polyurethane resins, polyamide resins, cellulose resins, polyether resins, and modified rosin; a mixture of the non-vinyl resins and the vinyl resins; or a graft polymer obtained by polymerizing vinyl monomers under coexistence of these materials.

The binder resin may be singly used or be used in combination of two or more types.

The content of the binder resin is, for example, preferably from 40% by weight to 95% by weight, more preferably from 50% by weight to 90% by weight, and further preferably from 60% by weight to 85% by weight, with respect to the entirety of the toner particles.

Coloring Agent

Examples of the coloring agent include various pigments such as carbon black, chrome yellow, hansa yellow, benzidine yellow, srene yellow, quinoline yellow, pigment yellow, permanent orange GTR, pyrazolone orange, vulcan orange, watching red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate; or various dyes of acridine, xanthene, azo, benzoquinone, azine, anthraquinone, thioindigo, dioxazine, thiazine, azomethine, indigo, phthalocyanine, aniline black, polymethine, triphenylmethane, diphenylmethane, thiazole, and the like.

The coloring agent may be singly used or be used in combination of two or more types.

As the coloring agent, a coloring agent which has been subjected to surface treatment if necessary may be used or may be used along with a dispersant. Plural types of coloring agents may be used together.

The content of the coloring agent is, for example, preferably from 1% by weight to 30% by weight, and more preferably from 3% by weight to 15% by weight, with respect to the entirety of the toner particles.

Release Agent

Examples of the release agent include hydrocarbon waxes; natural waxes such as carnauba waxes, rice waxes, and candelilla waxes; synthetic waxes, or mineral and petroleum waxes such as montan waxes; and ester waxes such as fatty acid esters and montan acid esters. The release agent is not limited thereto.

The melting temperature of the release agent is preferably from 50° C. to 110° C. and more preferably from 60° C. to 100° C.

The melting temperature is obtained from the DSC curve obtained by differential scanning caloric measurement (DSC) according to "the melting peak temperature" disclosed in the part of obtaining of the melting temperature in JIS K 7121-1987 "Testing Methods for Transition Temperatures of Plastics".

The content of the release agent is, for example, preferably from 1% by weight to 20% by weight and more preferably from 5% by weight to 15% by weight, with respect to the entirety of the toner particles.

Other Additives

Examples of other additives include a known additive such as a magnetic material, a charge-controlling agent, inorganic powder. The additives are contained in the toner particle, as an internal additive.

Characteristics of Toner Particle

The toner particle may be a toner particle having a single-layer structure or be a toner particle having a so-called core-shell structure which is configured from a core (core particle) and a shell layer for covering the core.

Here, the toner particle of the core-shell structure may be configured from a core and a shell layer. The core may be configured to, for example, contain a binder resin and, if necessary, other additives such as the coloring agent and the release agent. The shell layer may be configured to contain a binder resin.

As described above, the volume average particle diameter (D50v) of the toner particles is from 3.0 μm to 5.5 μm, and preferably from 3.0 μm to 4.0 μm.

Various types of average particle diameters of the toner particles and various types of particle diameter distribution index are measured by using COULTER MULTISIZER II (manufactured by Beckman Coulter Inc.). An electrolyte is measured by using ISOTON-II (manufactured by Beckman Coulter Inc.).

In measurement, a measurement sample of from 0.5 mg to 50 mg is added into 2 ml of a 5% aqueous solution of a surfactant (sodium alkylbenzene sulfonate is preferable). A resultant of the addition is added into an electrolyte of from 100 ml to 150 ml.

The electrolyte in which the sample has been suspended is subjected to dispersing for 1 minute in an ultrasonic dispersing device. The particle diameter distribution of particles having a particle diameter in a range of from 2 μm to 60 μm is measured by COULTER MULTISIZER II. The particle diameter distribution is measured by using an aperture of 100 μm as an aperture diameter. The number of particles to be subjected to sampling is 50,000.

Regarding particle diameter ranges (channels) obtained divided based on the measured particle diameter distribution, cumulative distribution for each of the volume and the number is drawn from the small diameter side. A particle diameter at 16% of the accumulation is defined as a volume particle diameter D16v and a number particle diameter D16p. A particle diameter at 50% of the accumulation is defined as a volume average particle diameter D50v and an accumulated number average particle diameter D50p. A particle diameter at 84% of the accumulation is defined as a volume particle diameter D84v and a number particle diameter D84p.

The volume particle diameter distribution index (GSDv) is calculated as $(D84v/D16v)^{1/2}$ by using these types of particle diameters, and the number particle diameter distribution index (GSDp) is calculated as $(D84p/D16p)^{1/2}$ by using these types of particle diameters.

The shape factor SF1 of the toner particles is preferably from 110 to 150, and more preferably from 120 to 140.

The shape factor SF1 is obtained by using the following expression.

$$SF1=(ML^2/A)\times(\pi/4)\times 100 \quad \text{Expression:}$$

In the expression, ML indicates an absolute maximum length of the toner, and A indicates a projected area of the toner.

Specifically, mainly, a microscopic image or a scanning electron microscope (SEM) image is analyzed by using an image analyzer, and thus the shape factor SF1 is quantified and is calculated as follows. That is, an optical microscope image of particles dispersed on a surface of slide glass is input to the LUZEX image analysis device by a video camera. The maximum length and the projected area of 100 particles are obtained, and are calculated by using the above expression. Then, an average value thereof is obtained, and thus the shape factor SF1 is obtained.

External Additive

Examples of the external additive include inorganic particles. Examples of the inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O$—$(TiO_2)n$, $Al_2O_3.2SiO_2$, $CaCO_3$, $MgCO_3$, $BaSO_4$, and $MgSO_4$.

Surfaces of the inorganic particles as the external additive may be treated with a hydrophobizing agent. The treatment with a hydrophobizing agent is performed by, for example, immersing the inorganic particles in the hydrophobizing agent. The hydrophobizing agent is not particularly limited. For example, a silane coupling agent, silicone oil, a titanate coupling agent, and an aluminum coupling agent are exemplified. The hydrophobizing agent may be singly used or be used in combination of two or more types.

The amount of the hydrophobizing agent is generally from 1 part by weight to 10 parts by weight with respect to 100 parts by weight of the inorganic particles.

Examples of the external additive include resin particles (resin particles of polystylene, polymethylmethacrylate (PMMA), a melamine resin, and the like), and a cleaning aid (for example, a metal salt of the higher fatty acid, which is represented by zinc stearate, and particles of a fluorine high molecular-weight material).

An externally-added amount of the external additive is, for example, preferably from 0.01% by weight to 5% by weight, and more preferably from 0.01% by weight to 2.0% by weight, with respect to the toner particles.

Method of Preparing Toner

Next, a preparing method of the toner according to the exemplary embodiment will be described.

The toner according to the exemplary embodiment is obtained in such a manner that toner particles are prepared, and then an external additive is externally added to the toner particles.

The toner particles may be prepared by using either of a dry type preparing method (for example, a kneading and pulverizing method) and a wet type preparing method (for example, an aggregation coalescence method, a suspension polymerization method, and a dissolution suspension method). The preparing method of the toner particles is not particularly limited to these preparing methods, and a known preparing method may be employed.

Among these methods, the toner particles may be obtained by using the aggregation coalescence method.

Specifically, for example, in a case where toner particles are prepared by using the aggregation coalescence method, the toner particles are prepared by using the following processes: a process (resin particle dispersion preparation process) of preparing a resin particle dispersion in which resin particles functioning as a binder resin are dispersed; a process (aggregation particle formation process) of aggregating the resin particles (if necessary, other particles) in the resin particle dispersion (if necessary, in the dispersion after other particle dispersions are mixed) so as to form aggregation particles; and a process (coalescence process) of heating an aggregation particle dispersion in which the aggregation particles are dispersed, so as to coalesce the aggregation particle, and of forming toner particles.

An external additive is added and mixed to the obtained toner particles, for example, in a dry state, and thus a toner is prepared. The mixing may be performed by, for example, the V blender, the HENSCHEL MIXER, the LOEDIGE MIXER, and the like. In addition, if necessary, coarse particles of the toner may be removed by using a vibration classifier, a wind classifier, and the like.

Developer

The developer contains at least the specific toner. The developer may be a single-component developer which contains only the specific toner or may be a two-component developer obtained by mixing the specific toner and a carrier.

The carrier is not particularly limited, and a well-known carrier is exemplified. Examples of the carrier include a covered carrier in which a surface of a core formed from magnetic particles is covered with a covering resin; a magnetic particle-dispersed type carrier in which magnetic particles are dispersed and mixed in a matrix resin; and a resin-impregnated carrier in which a resin is impregnated in porous magnetic particles.

The magnetic particle-dispersed type carrier and the resin-impregnated carrier may be carriers in which component particles of the above carriers are defined as a core, and the core is covered with a covering resin.

A mixing ratio (weight ratio) of the toner and the carrier in the two-component developer is preferably from 1:100 to 30:100 as toner:carrier, and more preferably from 3:100 to 20:100.

Figure 4:
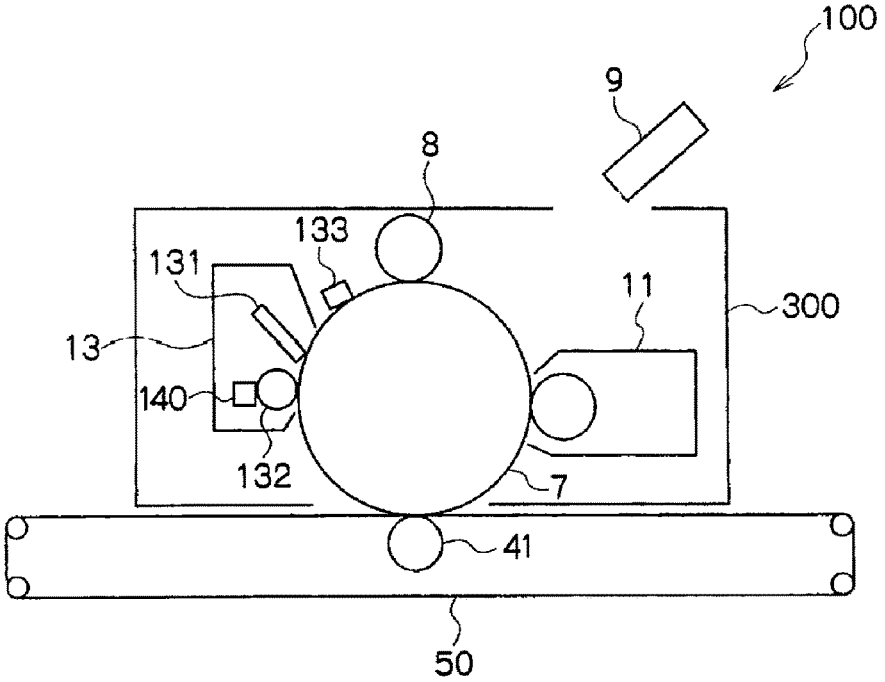
FIG. 4 is a schematic configuration diagram illustrating an example of an image forming apparatus according to the exemplary embodiment, which includes an intermediate transfer type transfer unit.

FIG. 4 is a schematic configuration diagram illustrating an example of the image forming apparatus which includes the intermediate transfer type transfer unit, among the image forming apparatuses according to the exemplary embodiment.

As illustrated in FIG. 4, an image forming apparatus 100 according to the exemplary embodiment includes a process cartridge 300 which includes an electrophotographic photoreceptor 7, an exposure device (an example of the electrostatic latent image forming unit) 9, a transfer device (primary transfer device) 41, and an intermediate transfer member 50. In the image forming apparatus 100, the exposure device 9 is disposed at a position in which the electrophotographic photoreceptor 7 may be exposed through the opening of the process cartridge 300, the transfer device 41 is disposed at a position facing the electrophotographic photoreceptor 7 through the intermediate transfer member 50, and the intermediate transfer member 50 is disposed so as to cause a portion thereof to contact with the electrophotographic photoreceptor 7. Although not illustrated, the image forming apparatus 100 further includes a secondary transfer device configured to transfer the toner image transferred to the intermediate transfer member 50, to a recording medium (for example, paper). The intermediate transfer member 50, the transfer device (primary transfer device) 41, and the secondary transfer device (not shown) correspond to an example of the transfer unit.

In FIG. 4, the process cartridge 300 integrally supports an electrophotographic photoreceptor 7, a charging device (an example of a charging unit) 8, a developing device (an example of a developing unit) 11, and a cleaning device (an example of a cleaning unit) 13 in a housing. The cleaning device 13 has a cleaning blade (an example of a cleaning member) 131. The cleaning blade 131 is disposed to contact with a surface of the electrophotographic photoreceptor 7. The cleaning member may be a conductive or insulating fibrous member instead of the form of the cleaning blade 131, and may be used alone or in combination with the cleaning blade 131.

FIG. 4 illustrates an example of an image forming apparatus which includes a fibrous member (roller-shaped) 132 and a fibrous member (flat brush-shaped) 133. The fibrous member 132 supplies a lubricating member 140 to the surface of the electrophotographic photoreceptor 7. The fibrous member 133 assists cleaning. However, these members are disposed as necessary.

The electrophotographic photoreceptor 7, the charging device 8, the exposure device 9 developing device 11, and the cleaning device 13 among the components of the image forming apparatus illustrated in FIG. 4 are similar to the electrophotographic photoreceptor 7, the charging device 15, the electrostatic latent image forming device 16, the developing device 18, and the cleaning device 13 in the image forming apparatus illustrated in FIG. 1, respectively. Thus, detailed descriptions thereof will be omitted.

The intermediate transfer member 50 and the transfer device (that is, the transfer device 41 and the secondary transfer device which is not illustrated) constituting the transfer unit will be described below.

Intermediate Transfer Member

As the intermediate transfer member 50, a belt-shaped transfer member (intermediate transfer belt) containing polyimide, polyamideimide, polycarbonate, polyarylate, polyester, rubber, or the like, which have been imparted with semiconductivity, is used. As a shape of the intermediate transfer member, a transfer member having a drum shape may be used in addition to the belt-shaped transfer member.

Transfer Device

Examples of the transfer device 41 include known transfer chargers such as a contact-type transfer charger using a belt, a roller, a film, a rubber blade, or the like, and scorotron transfer chargers and corotron transfer chargers which utilize corona discharge.

A power source (not illustrated) applies a transfer voltage of polarity opposite to the polarity of the toner, to the transfer device 41, and thus a transfer current (primary transfer current) flows between the transfer device 41 and the electrophotographic photoreceptor 7, and a toner image on the electrophotographic photoreceptor 7 is transferred to the intermediate transfer member 50.

The primary transfer current value is preferably from 20 μA to 100 μA, and more preferably from 30 μA to 80 μA, from a viewpoint of achieving prevention of poor transfer and prevention of the occurrence of ghost.

The secondary transfer device (not illustrated) has a configuration similar to that of the transfer device 41 except for transferring the toner image on the intermediate transfer member 50, to a recording medium.

Figure 5:
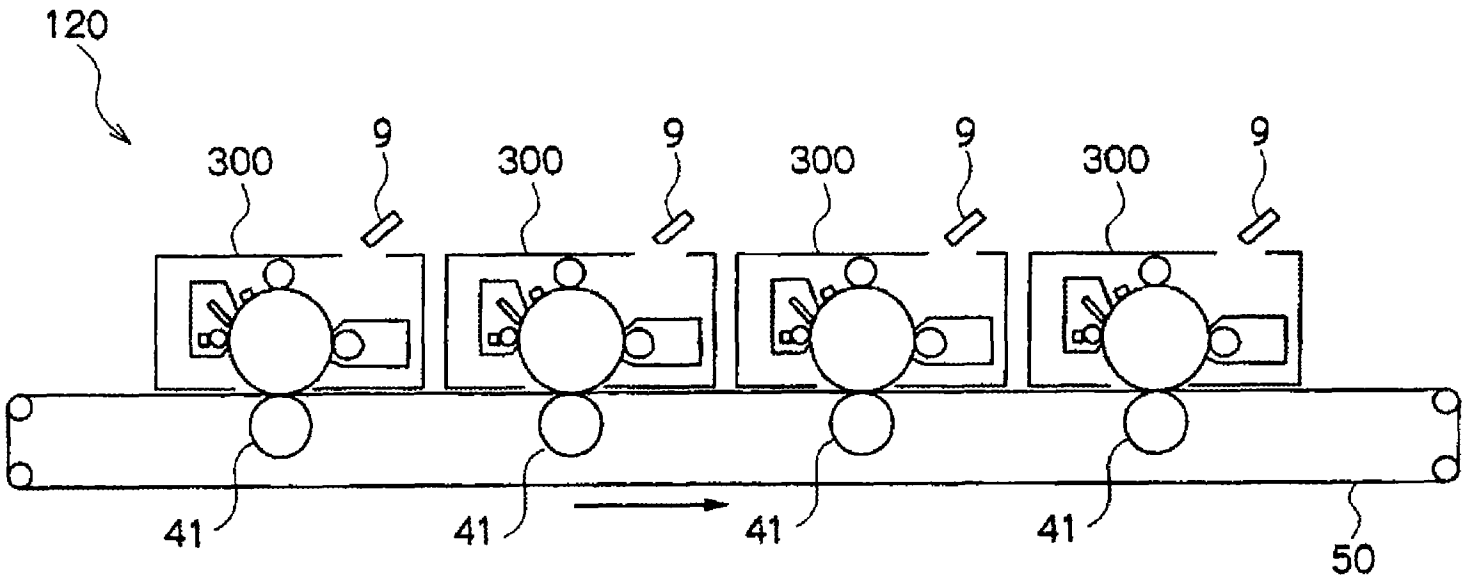
FIG. 5 is a schematic configuration diagram illustrating another example of the image forming apparatus according to the exemplary embodiment, which includes the intermediate transfer type transfer unit.

FIG. 5 is a schematic configuration diagram illustrating another example of the image forming apparatus which includes the intermediate transfer type transfer unit, among the image forming apparatuses according to the exemplary embodiment.

The image forming apparatus 120 illustrated in FIG. 5 is a tandem type multi-color image forming apparatus in which four process cartridges 300 are mounted. The image forming apparatus 120 has a configuration in which the four process cartridges 300 are disposed in parallel on the intermediate transfer member 50, and one electrophotographic photoreceptor is used per color. Further, the image forming apparatus 120 has a configuration similar to that of the image forming apparatus 100, except for being a tandem type.

EXAMPLES

The exemplary embodiment will be described below in detail by using examples. The exemplary embodiment is not limited to the examples. In the following description, "part(s)" and "%" are all based on weight unless otherwise specified.

Preparation of Photoreceptor

Photoreceptor 1

Forming of Undercoat Layer 100 parts by weight of zinc oxide (product name: mz300, manufactured by Tayca Corporation, volume average particle diameter: 70 nm, and BET specific surface area: 15 $m^2/g$) as metal oxide particles, 10 parts by weight of a 10 wt % toluene solution of γ-aminopropyltriethoxysilane as a silane coupling agent, and 200 parts by weight of toluene are mixed. The mixture is stirred and refluxed for 2 hours. Then, toluene is distilled off under reduced pressure of 10 mmHg and the residue is subjected to a baking surface treatment at 135° C. for 2 hours. Thus, surface-treated metal oxide particles are obtained.

33 parts by weight of the obtained surface-treated metal oxide particles, 6 parts by weight of blocked isocyanate (product name: SUMIDUR 3175 manufactured by Sumitomo Bayer Urethane Co., Ltd.) as a curing agent, 1 part by weight of an exemplary compound (1-9) as an electron accepting compound, and 25 parts by weight of methyl ethyl ketone are mixed for 30 minutes. Then, 5 parts by weight of a butyral resin (product name: S-LEC BM-1, manufactured by Sekisui Chemical Co., Ltd.) as a binder resin, 3 parts by weight of a silicone ball (product name: TOSPEARL 120, manufactured by Momentive Performance Materials Inc.), and 0.01 part by weight of a silicone oil as a leveling agent (product name: SH29PA, manufactured by Toray Dow Corning Silicone Co., Ltd.) are added thereto. The mixture is dispersed for 1 hour by using a sand mill (that is, dispersion time is set to be one hour), thereby a coating liquid for forming an undercoat layer is obtained.

An aluminum substrate (electroconductive substrate) having a diameter of 84 mm, a length of 357 mm, and a thickness of 1.0 mm is coated with the coating liquid for forming an undercoat layer by a dip coating method. Then, dry curing is performed at 180° C. for 30 minutes, thereby an undercoat layer having a thickness of 20 μm is obtained.

Forming of Charge Generation Layer 15 parts by weight of a hydroxygallium phthalocyanine pigment as a charge generating material, 10 parts by weight of a vinyl chloride-vinyl acetate copolymer resin (product name: VMCH, manufactured by NUC Ltd.) as a binder resin, and 300 parts by weight of n-butyl alcohol as a solvent are mixed. The hydroxygallium phthalocyanine pigment has strong diffraction peaks at at least 7.5°, 9.9°, 12.5°, 16.3°, 18.6°, 25.1°, and 28.3° of Bragg angles (2θ±0.2°) for CuKα characteristic X-rays. The mixture is dispersed by using a sand mill for 4 hours, thereby a coating liquid for forming a charge generation layer is obtained.

The obtained coating liquid for forming a charge generation layer is applied onto the undercoat layer by a dip coating. Drying is performed at 100° C. for 10 minutes, thereby a charge generation layer having a film thickness of 0.2 μm is obtained.

Forming of Charge Transport Layer 4 parts by weight of N,N'-diphenyl-N,N'-bis(3-methylphenyl) [1,1'-biphenyl]-4,4'-diamine as a charge transporting material, 6 parts by weight of bisphenol Z polycarbonate resin (weight-average molecular weight: 40,000) as a binder resin are added to a solvent mixture of 24 parts by weight of tetrahydrofuran and 5 parts by weight of chlorobenzene. Thus, a coating liquid for forming a charge transport layer is obtained.

The obtained coating liquid for forming a charge transport layer is applied onto the charge generation layer. Drying is performed at 130° C. for 40 minutes, thereby a charge transport layer having a film thickness of 35 μm is formed. Thus, a desired electrophotographic photoreceptor is obtained.

Measuring of Electrostatic Capacitance of Undercoat Layer

The coating liquid for forming an undercoat layer obtained when the undercoat layer is formed is applied onto an aluminium substrate having a diameter of 30 mm and a length of 340 mm, by dip coating. Dry curing is performed at 180° C. for 30 minutes, thereby an undercoat layer having a thickness of 20 μm is obtained. Gold electrodes of φ6 mm as facing electrodes are formed on the undercoat layer. Measurement is performed at a normal temperature and normal humidity (22° C./50% RH) by the 126096 W impedance analyzer (manufactured by Solartron Corp.). The measurement is performed at a DC bias of 0 V, AC±1V, in a frequency range of 1 to 100 Hz. Thus, electrostatic capacitance per unit area of the undercoat layer ("electrostatic capacitance" in Table) is obtained. The results are shown in Table 1.

Photoreceptor 2

An electrophotographic photoreceptor is obtained in a manner similar to that for Photoreceptor 1 when an undercoat layer of Photoreceptor 1 is formed, except that an amount of the binder resin is reduced up to 3.5 parts by weight.

Measurement is performed by using the obtained coating liquid for forming an undercoat layer, in a manner similar to that for Photoreceptor 1, and thus electrostatic capacitance per unit area in the undercoat layer ("electrostatic capacitance" in Table) is obtained. The results are shown in Table 1.

Photoreceptor 3

An electrophotographic photoreceptor is obtained in a manner similar to that for Photoreceptor 1 when an undercoat layer of Photoreceptor 1 is formed, except that an amount of the binder resin is increased up to 6.5 parts by weight.

Measurement is performed by using the obtained coating liquid for forming an undercoat layer, in a manner similar to that for Photoreceptor 1, and thus electrostatic capacitance per unit area in the undercoat layer ("electrostatic capacitance" in Table) is obtained. The results are shown in Table 1.

Photoreceptor C1

An electrophotographic photoreceptor is obtained in a manner similar to that for Photoreceptor 1 when an undercoat layer of Photoreceptor 1 is formed, except that a dispersion time is reduced to be 40 minutes.

Measurement is performed by using the obtained coating liquid for forming an undercoat layer, in a manner similar to that for Photoreceptor 1, and thus electrostatic capacitance per unit area in the undercoat layer ("electrostatic capacitance" in Table) is obtained. The results are shown in Table 1.

Photoreceptor C2

An electrophotographic photoreceptor is obtained in a manner similar to that for Photoreceptor 1 when an undercoat layer of Photoreceptor 1 is formed, except that a dispersion time is further reduced to be 20 minutes.

Measurement is performed by using the obtained coating liquid for forming an undercoat layer, in a manner similar to that for Photoreceptor 1, and thus electrostatic capacitance per unit area in the undercoat layer ("electrostatic capacitance" in Table) is obtained. The results are shown in Table 1.

Preparation of Toner

Toner 1

Synthesis of Polyester Resin 124 parts by weight of ethylene glycol, 22.2 parts by weight of sodium dimethyl 5-sulfoisophthalate, 213 parts by weight of dimethyl sebacate, and 0.3 parts by weight of dibutyl tin oxide as a catalyst are put into a three-necked flask which has been heated and dried. Then, a decompression operation causes an air in a container to be set to be under an inert atmosphere by using a nitrogen gas. Then, stirring is performed at 180° C. for 5 hours by mechanical stirring. Then, the temperature slowly rises up to 220° C. under decompression, and stirring is performed for 4 hours. The resultant of the stirring is air-cooled in a viscous state, and thus the reaction is stopped, thereby 220 parts by weight of the polyester resin is synthesized.

In measuring the molecular weight (polystyrene conversion) by gel permeation chromatography, the weight average molecular weight ($M_w$) of the obtained polyester resin is 19,000 and the number average molecular weight ($M_n$) thereof is 5,800.

The melting temperature (Tm) of the polyester resin is measured by using the above-described measuring method, and by using a differential scanning calorimeter (DSC). The measured melting temperature has a clear peak, and the temperature at a peak top is 70° C.

Preparation of Dispersion 150 parts by weight of the obtained polyester resin are put into 850 parts by weight of distilled water, and are mixed and stirred in a homogenizer (ULTRA-TURRAX manufactured by IKA Japan Corp.) while being heated at 80° C. Thus, a resin particle dispersion is obtained.

Then, 250 parts by weight of carbon black, 20 parts by weight of an anion surfactant (NEOGEN RK manufactured by DKS Co., Ltd.), and 700 parts by weight of ion exchange water are mixed and dissolved. Then, the mixture is dispersed by using a homogenizer (ULTRA-TURRAX manufactured by IKA Corp.), and a coloring agent dispersion in which a coloring agent is dispersed is prepared.

Then, 100 parts by weight of a paraffin wax (HNP0190 manufactured by Nippon Seiro Co., Ltd., melting temperature: 85° C.), 5 parts by weight of a cation surfactant (SANISOL B50 manufactured by Kao Corp.), 240 parts by weight of ion exchange water are dispersed in a round stainless steel flask for 10 minutes by using a homogenizer (ULTRA-TURRAX T50 manufactured by IKA Corp.). Then, dispersion treatment is performed by a pressure discharge type homogenizer, and thus a release agent particle dispersion in which release agent particles having an average particle diameter of 550 nm are dispersed is prepared.

Preparation of Toner Particle 6 parts by weight of aluminum sulfate (manufactured by Wako pure chemical Industries.) and 100 parts by weight of ion exchange water are accommodated in a round stainless steel flask, in addition to 2400 parts by weight of the obtained resin particle dispersion, 100 parts by weight of the obtained coloring agent dispersion, and 63 parts by weight of the obtained release agent particle dispersion. pH thereof is adjusted to be 2.0, and then, dispersion is performed by using a homogenizer (ULTRA-TURRAX T50 manufactured by IKA Corp.). Then, the resultant of the dispersion is heated up to 65° C. in a heating oil bath, with stirring. Heating and stirring at 65° C. for 2 hours is maintained.

Then, an aqueous solution in which sodium carbonate (manufactured by Wako pure chemical Industries.) is diluted so as to be 0.5% by weight is gently added, and pH thereof is adjusted to be 5.0. Then, heating is performed up to 75° C. (that is, a heating temperature is set to 75° C.) while stirring continues, and the resultant of the heating is held for 3.5 hours (that is, a holding time is set to 3.5 hours).

Then, a reaction product is filtered, and the residue is sufficiently washed with ion exchange water. Then, drying is performed by using a vacuum dryer, and thus Toner particles 1 are obtained.

The obtained Toner particles 1 have a volume average particle diameter of 3.8 μm, and a shape factor of SF1=133.

External Addition of Toner Particles 100 parts by weight of the obtained Toner particles 1 and 0.5 parts by weight of silica particles (volume average particle diameter of 40 nm) as an external additive, which has been treated with hexamethyldisilazane are mixed in the HENSCHEL MIXER of 75 L for 10 minutes. Then, classification is performed by a blow-through type classifier (HI-BOLTER 300 manufactured by Toyo Hitec Co., LTD.), and thus Toner 1 is prepared.

Toner 2

Toner particles 2 are obtained in a manner similar to that for Toner particles 1 when toner particles of Toner 1 are prepared, except that pH is adjusted to be 5.0, and then the heating temperature is set to 95° C., and the holding time is set to 3 hours.

The obtained Toner particles 2 have a volume average particle diameter of 5.8 μm, and a shape factor of SF1=133.

Toner 2 is obtained in a manner similar to that for Toner 1, except for using Toner particles 2 instead of Toner particles 1.

Preparation of Developer

Preparation of Carrier

A mixture of 0.15 parts by weight of vinylidene fluoride, 1.35 parts by weight of a copolymer resin (polymerization ratio 80:20) of methyl methacrylate and trifluoroethylene with respect to 100 parts by weight of a ferrite core is obtained. The ferrite core having an average particle diameter of 50 μm is covered (coated) with resin by using the mixture and by using a kneader device, and thus a carrier is prepared.

Mixing of Toner and Carrier 8 parts by weight of each of the obtained toner (Toner 1 and Toner 2) and 100 parts by weight of the obtained carrier are mixed in a V blender having 2 L, and thus Developer 1 and Developer 2 are prepared, respectively.

Evaluation

Evaluation of Occurrence of Ghost

The photoreceptor shown in Table 1 and the developer shown in Table 1 are set to have the transfer current value shown in Table 1, in a modifier of an image forming apparatus (Multifunction machine: DocuCentre f1100 manufactured by Fuji Xerox Co., Ltd.). The following image (ghost chart) is formed on 10 sheets. An image on the 10th sheet is visually confirmed, and the occurrence of ghost is evaluated based on the following evaluation criteria. Table 1 represents results.

The "ghost chart" specifically means one piece of an image obtained in such a manner that a cross image having image density of 100% is formed at the first cycle at a photoreceptor cycle pitch, a white image having image density of 0% is formed at the second cycle, and a half-tone image having image density of 50% is formed at the third cycle on paper of A3. Density unevenness on the half-tone image (image at the third cycle) in the 10th sheet of the ghost chart is visually observed. It is recognized that the occurrence of ghost is prevented if a result of the observation is equal to or lower than G3.0 in the following evaluation criteria.

Evaluation Criteria of Occurrence of Ghost

G1.0: ghost does not occur

G2.0: recognition of ghost is difficult

G3.0: ghost, which is capable of being recognized when observed sufficiently, occurs, but it is in an allowable range G4.0: ghost occurs to such an extent that it is capable of being recognized, and it is outside of the allowable range G5.0: ghost occurs to such an extent that it is capable of being recognized clearly, and it is outside of the allowable range Evaluation of Image Quality (Image Density)

The photoreceptor shown in Table 1 and the developer shown in Table 1 are mounted in a modifier of an image forming apparatus (Multifunction machine: DocuCentre f1100 manufactured by Fuji Xerox Co., Ltd.), and are set to have the transfer current value shown in Table 1. A rectangular pattern of 15 mm angle as an image for ghost evaluation is printed on 10 sheets by one turn of the electrophotographic photoreceptor under conditions of a temperature of 10° C. and humidity of 15% RH. Then, a half-tone image (image density of 5%) is printed on the entire surface of the sheet at the next cycle, and a ghost image appearing on the half-tone image is evaluated based on the following criteria. The image density is measured by X-Rite404 (manufactured by X-Rite Corp.). The evaluation criteria are as follows. Table 1 shows results. It is recognized that the image quality is good if a result of the observation is equal to or lower than G2.0 in the following evaluation criteria.

Evaluation Criteria of Image Quality (Image Density)

G0.5: difference of image density is less than 1%

G1.0: difference of image density is equal to or more than 1% and less than 3%

G1.5: difference of image density is equal to or more than 3% and less than 5%

G2.0: difference of image density is equal to or more than 5% and less than 7%

G2.5: difference of image density is equal to or more than 7% and less than 10%

G3.0: difference of image density is equal to or more than 10%

TABLE 1

| | Photoreceptor | | Developer | | | Evaluation | |
|---|---|---|---|---|---|---|---|
| | Photoreceptor No | Electrostatic capacitance (pF/cm$^2$) | Developer No | Volume average particle diameter of toner particles (μm) | Transfer current value (μa) | Ghost | Image quality |
| Example 1 | Photoreceptor 1 | 50 | Developer 1 | 3.8 | 30 | 1.0 | 2.0 |
| Example 2 | Photoreceptor 1 | 50 | Developer 1 | 3.8 | 50 | 2.0 | 1.0 |
| Example 3 | Photoreceptor 1 | 50 | Developer 1 | 3.8 | 80 | 3.0 | 0.5 |
| Example 4 | Photoreceptor 2 | 20 | Developer 1 | 3.8 | 50 | 2.0 | 1.0 |
| Example 5 | Photoreceptor 3 | 80 | Developer 1 | 3.8 | 50 | 2.0 | 1.0 |
| Comparative Example 1 | Photoreceptor C1 | 150 | Developer 1 | 3.8 | 30 | 4.0 | 2.0 |
| Comparative Example 2 | Photoreceptor C2 | 200 | Developer 1 | 3.8 | 50 | 5.0 | 2.0 |
| Comparative Example 3 | Photoreceptor C2 | 200 | Developer 1 | 3.8 | 80 | 5.0 | 1.5 |
| Reference Example 1 | Photoreceptor 1 | 50 | Developer 2 | 5.8 | 80 | 1.0 | 1.0 |
| Reference Example 2 | Photoreceptor C2 | 200 | Developer 2 | 5.8 | 80 | 2.0 | 1.0 |

In the example, it is recognized that the occurrence of ghost is prevented in comparison to a comparative example, based on the above results. In the reference examples of using a toner which contains toner particles of which the volume average particle diameter is out of the above range, it is recognized that the problem regarding the ghost does not occur regardless of the electrostatic capacitance per unit area of the undercoat layer in the photoreceptor.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor which includes (i) an electroconductive substrate, (ii) an undercoat layer which is provided on the electroconductive substrate, contains a binder resin, a metal oxide particle, and an electron accepting compound, and has an electrostatic capacitance per unit area of from 10 pF/cm$^2$ to 100 pF/cm$^2$, and (iii) a photosensitive layer provided on the undercoat layer;

a charging unit configured to charge a surface of the electrophotographic photoreceptor;

an electrostatic latent image forming unit configured to form an electrostatic latent image on a charged surface of the electrophotographic photoreceptor;

a developing unit configured to store a developer containing a toner which contains toner particles of which a volume average particle diameter is from 3.0 μm to 5.5 μm, and develop the electrostatic latent image formed on the surface of the electrophotographic photoreceptor by using the developer, so as to form a toner image; and a transfer unit configured to transfer the toner image formed on the surface of the electrophotographic photoreceptor, onto a surface of a recording medium, wherein the electron accepting compound represented by following formula (1)

Formula (1)

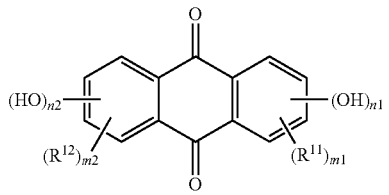

wherein n1 and n2 each independently represent an integer of from 0 to 3, with the proviso that at least one of n1 and n2 represents an integer of from 1 to 3; m1 and m2 each independently represent an integer of 0 or 1; R$^{11}$ and R$^{12}$ each independently represent an alkoxy group having from 1 to 10 carbon atoms, with the proviso that at least one of m1 or m2 represents an integer of 1.

2. The image forming apparatus according to claim 1, wherein the undercoat layer has an electrostatic capacitance of from 10 pF/cm$^2$ to 30 pF/cm$^2$.

3. The image forming apparatus according to claim 1, wherein the undercoat layer has an electrostatic capacitance of from 15 pF/cm$^2$ to 25 pF/cm$^2$.

4. The image forming apparatus according to claim 1, wherein a value of a transfer current for transferring the toner image formed on the surface of the electrophotographic photoreceptor in the transfer unit is from 20 μA to 100 μA.

5. The image forming apparatus according to claim 4, wherein the value of a transfer current is from 30 μA to 80 μA.

6. The image forming apparatus according to claim 1, wherein the metal oxide particle includes at least one selected from the group consisting of a tin oxide particle, a titanium oxide particle, and a zinc oxide particle.

7. The image forming apparatus according to claim 1, wherein a volume average primary particle diameter of the metal oxide particles is from 30 nm to 100 nm.

8. The image forming apparatus according to claim 1, wherein the metal oxide particle is treated with at least one coupling agent.

9. The image forming apparatus according to claim 7, wherein the coupling agent includes at least one selected from the group consisting of a silane coupling agent, a titanate coupling agent, and an aluminum coupling agent.

10. The image forming apparatus according to claim 1, wherein a thickness of the undercoat layer is from 15 μm to 30 μm.

11. The image forming apparatus according to claim 1, wherein a thickness of the undercoat layer is from 20 μm to 25 μm.

12. An image forming method comprising:

charging a surface of an electrophotographic photoreceptor including (i) an electroconductive substrate, (ii) an undercoat layer which is provided on the electroconductive substrate, contains a binder resin a metal oxide particle, and an electron accepting compound and has an electrostatic capacitance per unit area of from 10 pF/cm$^2$ to 100 pF/cm$^2$, and (iii) a photosensitive layer provided on the undercoat layer;

forming an electrostatic latent image on a charged surface of the electrophotographic photoreceptor;

developing the electrostatic latent image formed on the surface of the electrophotographic photoreceptor by using a developer which contains a toner containing toner particles of which a volume average particle diameter is from 3.0 μm to 5.5 μm; and transferring the toner image onto a surface of a recording medium, wherein the electron accepting compound represented by formula (1)

Formula (1)

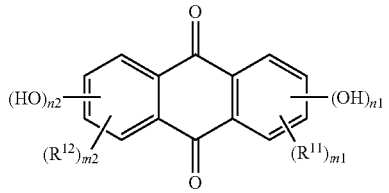

wherein n1 and n2 each independently represent an integer of from 0 to 3, with the proviso that at least one of n1 and n2 represents and integer of from 1 to 3; m1 and m2 each independently represent an integer of 0 or 1; and $R^{11}$ and $R^{12}$ each independently represent an alkoxy group having from 1 to 10 carbon atoms, with the proviso that at least one of m1 or m2 represents an integer of 1.

* * * * *